US005951009A

United States Patent [19]

Miyamoto et al.

[11] Patent Number: 5,951,009

[45] Date of Patent: Sep. 14, 1999

[54] GAME APPARATUS

[75] Inventors: Kojiro Miyamoto; Yutaka Yokoyama; Shigetoshi Mizuno, all of Tokyo, Japan

[73] Assignee: Sega Enterprises, Ltd.

[21] Appl. No.: 08/765,767

[22] PCT Filed: May 10, 1996

[86] PCT No.: PCT/JP96/01247

§ 371 Date: Aug. 8, 1997

§ 102(e) Date: Aug. 8, 1997

[87] PCT Pub. No.: WO96/35493

PCT Pub. Date: Nov. 14, 1996

[30] Foreign Application Priority Data

May 12, 1995 [JP] Japan ..... 7-114639

[51] Int. Cl.[6] ..... A63F 7/02

[52] U.S. Cl. ..... 273/121 B

[58] Field of Search ..... 273/121 B, 121 D, 273/121 E

[56] References Cited

U.S. PATENT DOCUMENTS

| | | | |
|---|---|---|---|
| 4,508,336 | 4/1985 | Yokoi | 273/121 B |
| 5,031,911 | 7/1991 | Okada | 273/121 B |
| 5,509,655 | 4/1996 | Ugawa | 273/121 B |
| 5,516,104 | 5/1996 | Takemoto et al. . | |
| 5,636,837 | 6/1997 | Takemoto et al. | 273/121 B |

FOREIGN PATENT DOCUMENTS

| | | | |
|---|---|---|---|
| 61-11625 | 4/1986 | Japan . | |
| 4-1961 | 1/1992 | Japan . | |
| 40/5103865 | 4/1993 | Japan | 273/121 B |
| 5-208071 | 8/1993 | Japan . | |
| 40/6023116 | 2/1994 | Japan | 273/121 B |
| 40/6098969 | 4/1994 | Japan | 273/121 B |
| 6-250115 | 9/1994 | Japan . | |
| 40/6312054 | 11/1994 | Japan | 273/121 B |
| 7-24703 | 3/1995 | Japan . | |
| 07116335 | 5/1995 | Japan . | |
| 7-116335 | 5/1995 | Japan . | |
| 2 230 463 | 10/1990 | United Kingdom . | |
| 2 250 208 | 6/1992 | United Kingdom . | |

OTHER PUBLICATIONS

British Examination Report, Oct. 15, 1998.

*Primary Examiner*—Raleigh W. Chiu
*Attorney, Agent, or Firm*—Dickstein Shapiro Morin & Oshinsky LLP

[57] ABSTRACT

An object is to provide a game apparatus in which it is possible to increase an operator's interest through a relatively compact arrangement. It has a transparent falling face 10 on which many pins 10*a* are provided and a medal M falls, a reciprocating target which is provided at a bottom portion of the falling face and performs a reciprocation movement, a transparent thin water tank 13 provided in front of the falling face, a large-size display 7 provided at the rear of the falling face, and a medal supply mechanism 30 which comprises a hopper 31 which pushes up a medal, a rising guiding path 32, first, second guiding path 33, 34, which guide the carrying of medals and medal supply gears 35, 36.

27 Claims, 15 Drawing Sheets

FIG. 10
FIG. 10a
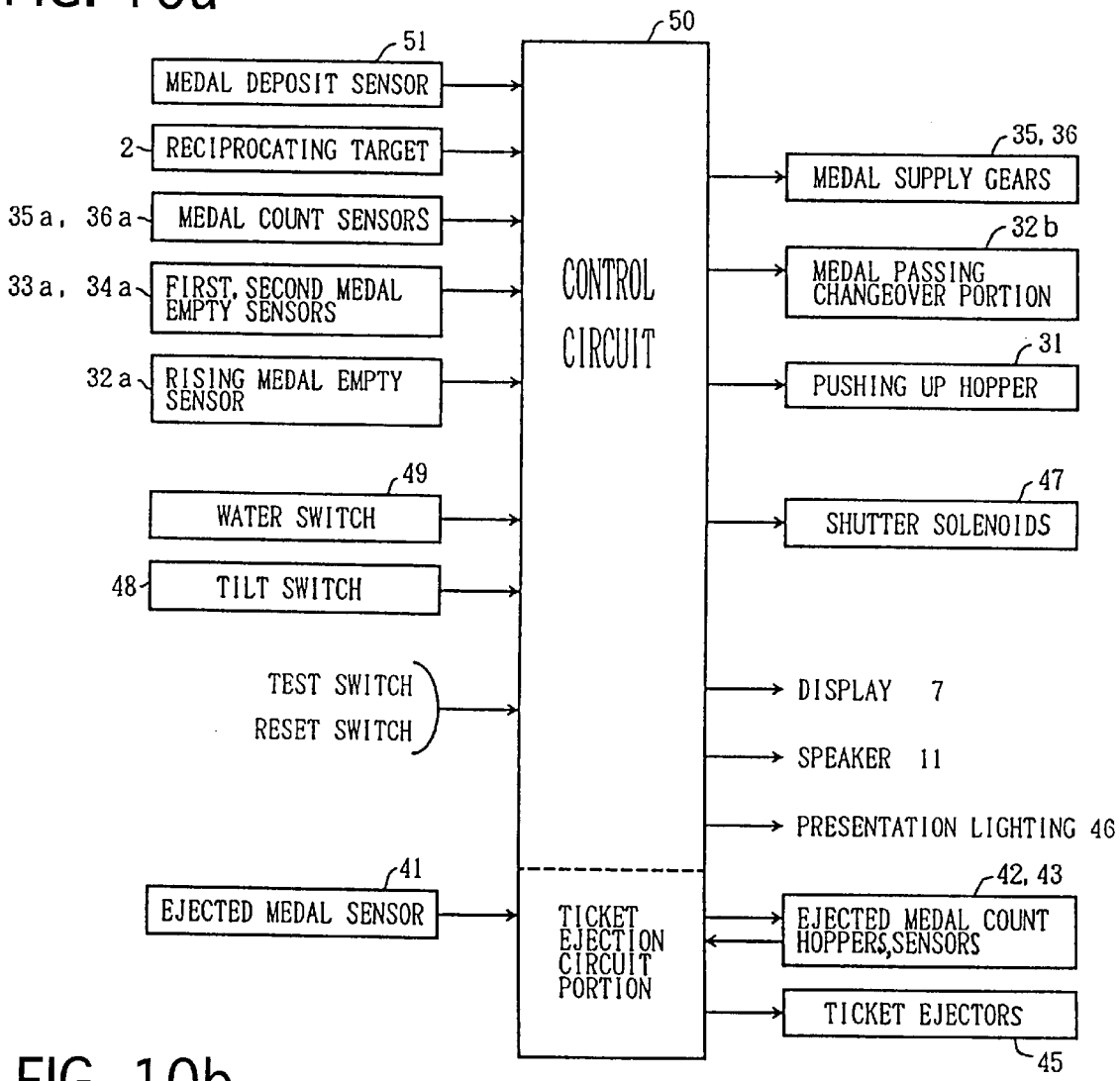
FIG. 10b
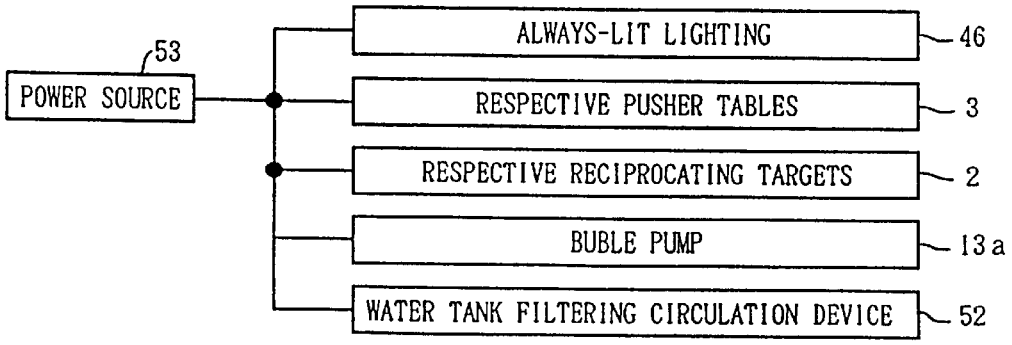

PRIOR ART

GAME APPARATUS

BACKGROUND OF THE INVENTION

1. Technical Field

The present invention relates to a game apparatus and in particular to a game apparatus in which a medal or the like is deposited, and the result of the game is determined by the movement thereof.

2. Background Art

Referring to FIG. 15, there is shown a medal game apparatus 100 as is typical in the prior art. This medal game apparatus has two playing positions for two operators, one on the left and one on the right. In each playing position, a falling face 110 is provided. This falling face 110 is a vertical surface and, like a pinball board, is provided with a plurality of pins 110*a* which extend therefrom for changing the direction of a falling medal. At the bottom of and in front of the falling face 110, a pusher table 103 is provided horizontally for receiving a medal which falls along the falling face 110. Along the falling face, a reciprocating target 102 is provided which reciprocates periodically across the falling face 110. At the bottom of and in front of the pusher table 103, a pusher field 104 is provided which receives medals M which drop from the pusher table 103. In a lower portion of the game apparatus 100, medal ejection pockets 105 are provided. Medal deposit holes 106 are provided above the falling face 110. A liquid crystal display 107 is provided within the central portion of the falling face 110.

In the medal game apparatus having the above-described arrangement, an operator deposits medal M into one of the medal deposit holes 106 and the deposited medal M falls along the falling face 110 due to gravity. As it falls, the medal M comes into contact with the plurality of pins 110*a* which are provided on the falling face 110, and thereby the falling direction of the medal M is changed. When the reciprocating target 102 is positioned in the path of the thus-falling medal M by chance, the medal M passes through the reciprocating target 102. In the reciprocating target 102, a medal passing sensor is provided which generates a medal detection signal when a medal M passes therethrough. This signal is input to a control circuit which triggers a medal supply mechanism to provide a predetermined number of additional medals M to the upper portion of the falling face 110. There, the additional medals M then fall along the falling face 110 due to gravity similar to the medal which was deposited by the operator via the deposit hole 106.

If a medal M, which is deposited via the deposit hole 106 and falls along the falling face 110, does not enter the reciprocating target 102, the medal falls directly onto the pusher table 103. If a medal M does enter the reciprocating target 102, it subsequently also falls onto the pusher table 103. A medal M, which has thus fallen onto the pusher table 103, then reciprocates together with a periodic reciprocation operation, in the rear direction of FIG. 15, of the pusher table, while the medal M remains on the pusher table 103. When the pusher table 103 moves in the rear direction of the figure, a rear-direction-side portion of the pusher table 103 is received by a table receiving hole which is provided at the bottom of the falling face 110 as the top surface of the pusher table 103 comes into contact with the bottom edge of the falling face 110. When medals M are placed on that portion, the medals are caught by the falling face 110 bottom edge, and thus slide along the pusher table 103, without being received by the table receiving hole. As a result, the medals M on the pusher table 103 are pushed out forward.

As a result of medals M falling along the falling face 110 one by one, many medals M collect on the pusher table 103 and, as a result of their being pushed forward by the above-mentioned forward and backward reciprocation operation of the pusher table 103, some medals M drop off the pusher table 103. The thus-dropping medals M fall onto the pusher field 104. As a result of the pusher table 103 performing the forward and backward reciprocation operation on the pusher field 104, the medals M on the pusher field 104, which are located on the rear direction side, are again pushed forward by the pusher table 103. Accordingly, when many medals M collect on the pusher field 104, this forward and backward movement of the pusher table 103 causes some medals M to drop off the pusher field 104.

The medals, which have thus dropped from the pusher field 104, fall due to gravity along a medal path which is provided inside the apparatus and, as a result, are ejected to the medal ejection pocket 105. The thus-ejected medals are then recovered by the operator located at that place or position.

When a medal M falling along the falling face 110 enters the reciprocating target 102, it is detected by the medal passing sensor and, as a result, a predetermined number of medals M are supplied to the upper portion of the falling face 110. A predetermined presentation program is then displayed on the liquid crystal display 107 in order to clearly indicate to the operator that the medal M has thus entered the reciprocating target 102, and also for increasing the interest of the operator in the game apparatus 100.

DISCLOSURE OF THE INVENTION

In similar medal game apparatuses 100 in the prior art, although there are liquid crystal displays 107 provided they are too small to clearly indicate to the operator that the medal M has entered the reciprocating target 102, and also too small to increase the operator's interest.

Further, although it would be preferable for a predetermined number of medals M to be quickly supplied to the upper portion of the falling face 110 through the medal supply mechanism whenever a medal falling along the falling face 110 enters the reciprocating target 102, this is not easily accomplished. Because the medals M have predetermined sizes and weights, a considerably large-scaled medal supply mechanism is needed for thus quickly supplying the predetermined number of medals M. In order to accommodate such a large-scaled medal supply mechanism, it is necessary to increase the size of the entirety of the game apparatus, which increases the cost of the game apparatus.

In consideration of these problems, the object of the present invention is to provide a game apparatus which allows the operator to clearly recognize when a medal M has entered the reciprocating target, which thereby increases the operator's interest in the game apparatus, and through a relatively simple mechanism, allows a predetermined number of medals to be rapidly supplied to the falling face upper portion when a medal has entered the reciprocating target.

BRIEF DESCRIPTION OF THE DRAWINGS

The objects, configurations and advantages of the present invention will become apparent from the following description with reference to the following drawings:

FIG. 3(*b*), is a side view of the medal game apparatus shown in FIG. 1.

FIG. 6(*b*) is a sectional view of the second guiding path and a rising guiding path. FIG. 6(*c*) is a plan view which shows a C-part of FIG. 5 of a part of a medal supply gear and a Geneva gear.

FIG. 10 is a block diagram showing a control circuit of the medal game apparatus shown in FIG. 1.

DETAILED DESCRIPTION OF THE PREFERRED EMBODIMENTS

Figure 1:
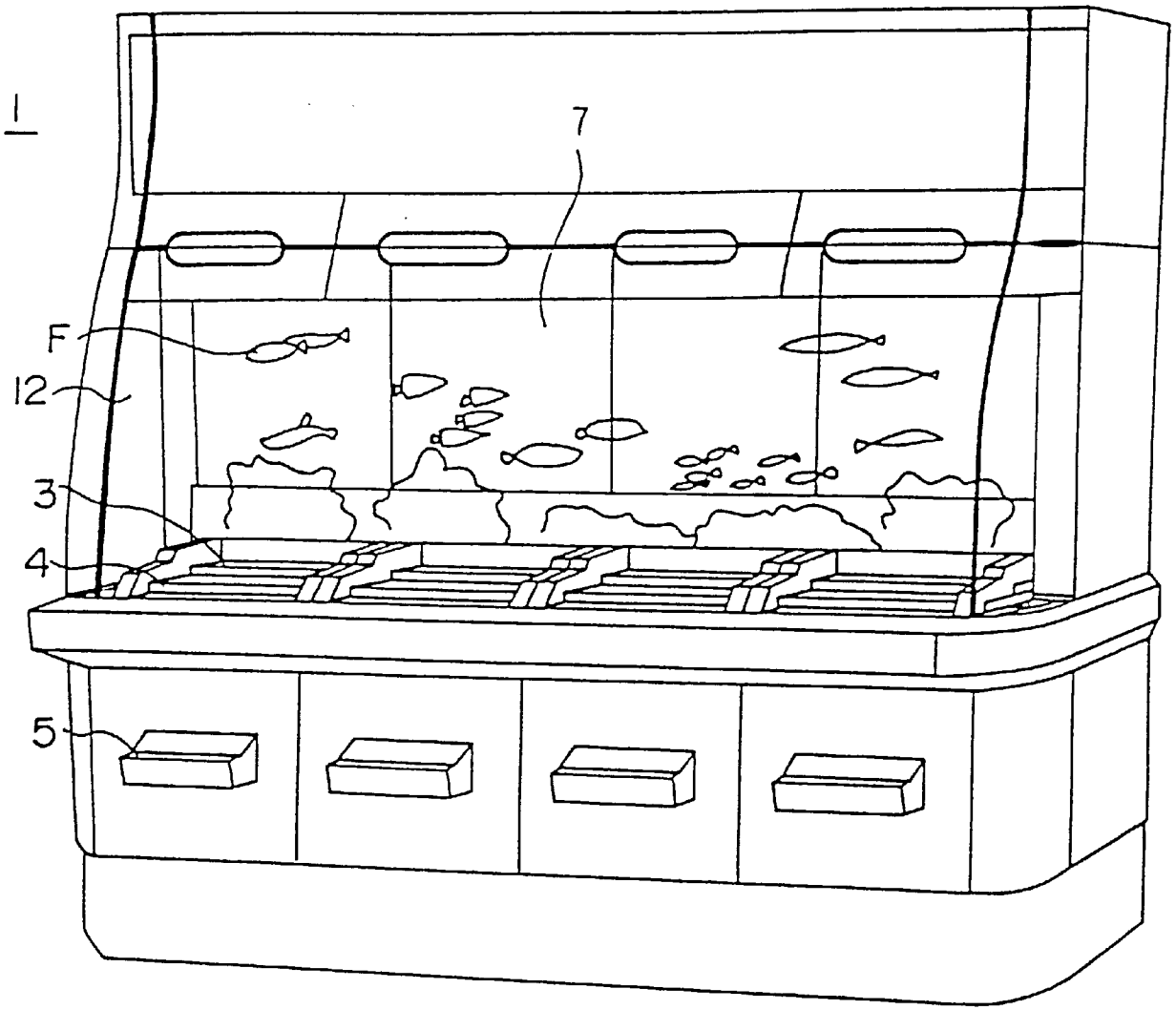
FIG. 1 is a perspective view of a medal game apparatus according to a first embodiment of the present invention.
Figure 2:
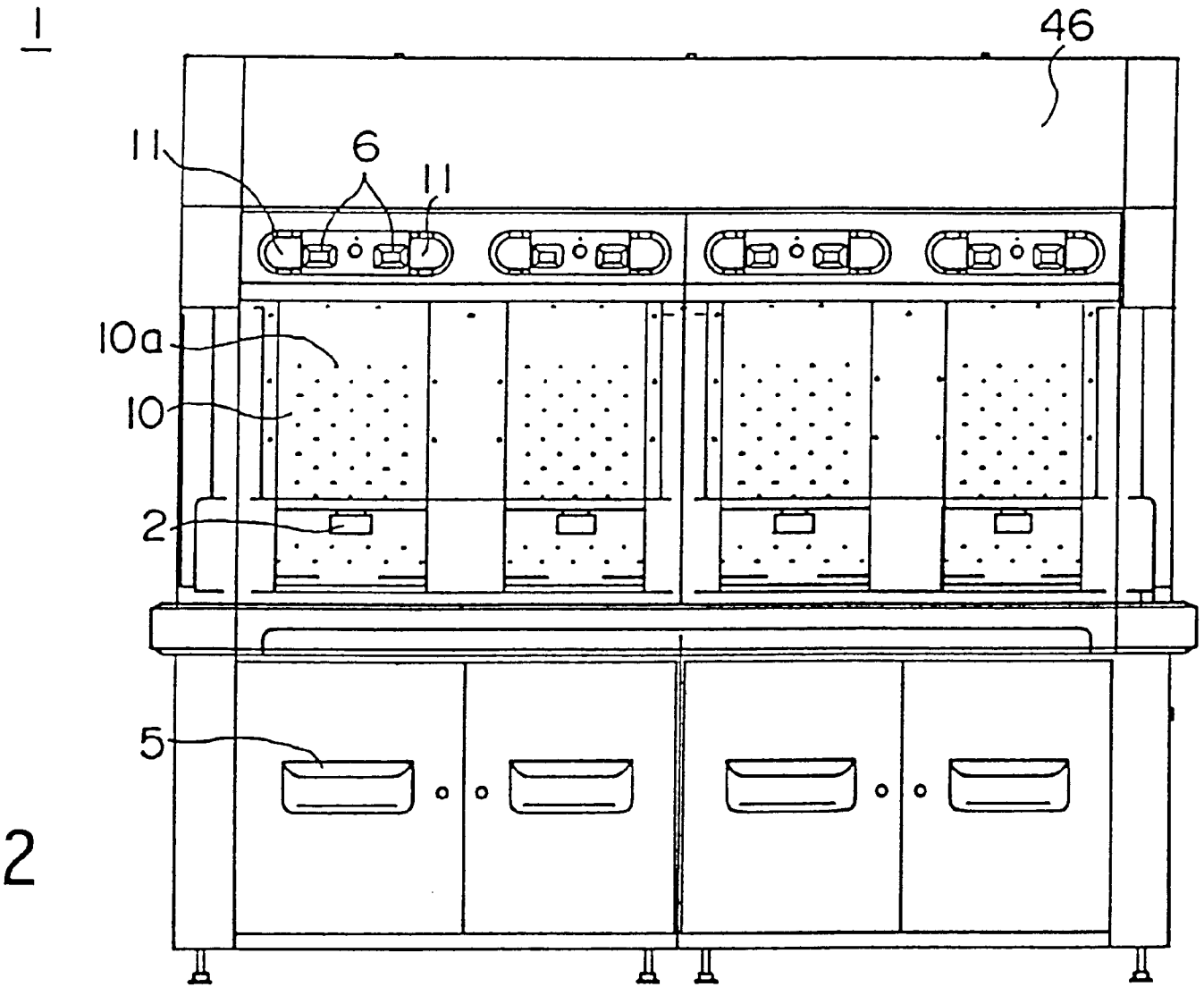
FIG. 2 is a front view of the medal game apparatus shown in FIG. 1.
Figure 3A:
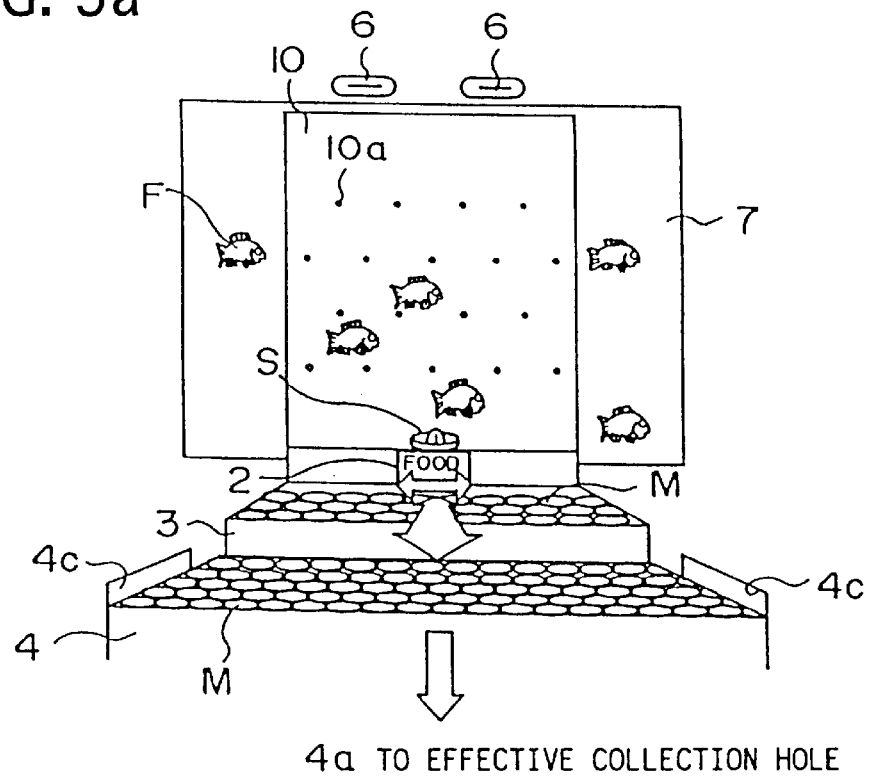
FIG. 3(*a*) is a front view of the medal game apparatus shown in FIG. 1.
Figure 3B:
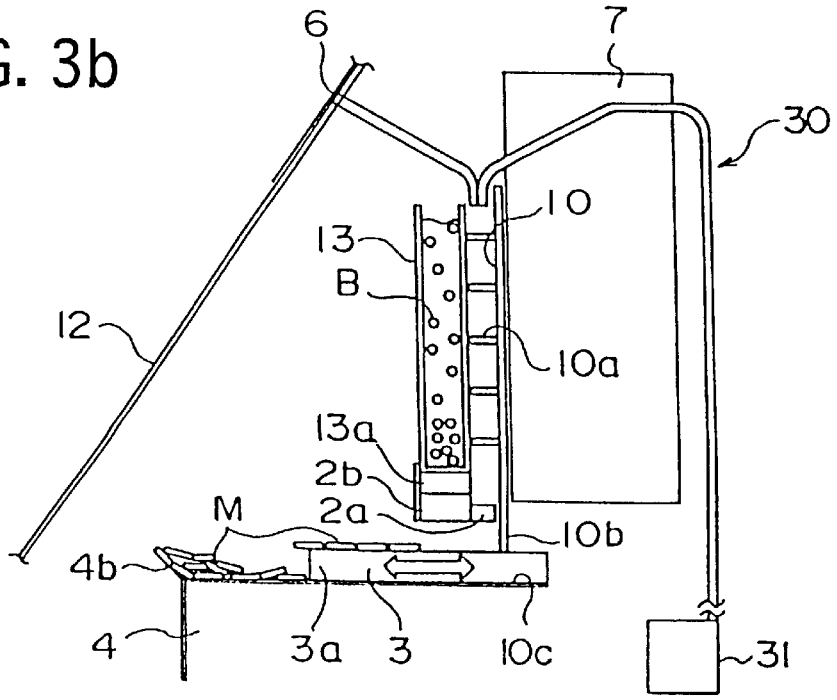

With reference to FIGS. 1, 2, 3 (*a*), and 3 (*b*), a summary of a medal game apparatus in a first embodiment of the present invention will now be described. As can be seen from FIG. 1, the medal game apparatus has four place units or positions which are arranged side by side so that a total of four operators can operate the apparatus at any one time.

As shown in FIG. 2, each place unit includes a thin plate falling face 10. This falling face is in a vertical plane, and, as a pinball board, a plurality of pins 10*a* are provided for changing a falling direction of a falling medal. In the embodiment, a medal M having an outer diameter of 24.2 mm and a thickness of 1.7 mm is used. A horizontal pusher table 3 is provided at the bottom, front side of the falling face 10, for receiving a medal M falling along the falling face 10. Further, at the top of the pusher table 3, as shown in FIG. 3 (*a*), a reciprocating target 2 which periodically moves back and forth along the falling face is provided. Such an operation of the reciprocating target is provided by a target operating mechanism 2*b* shown in FIG. 3 (*b*). A pusher field 4 is provided at the bottom, front side of the pusher table 3 for receiving medals M which drop from the pusher table 3. In a lower portion of the medal game apparatus 1, medal ejection pockets 5 are provided. Medal deposit holes 6 are provided at the top of the falling faces 10. In the rear of the falling face 10, a large Projection TV (PTV) display 7 is provided. This display 7 is not required to be limited to the PTV, and may be another display device, such as CRT (Cathode Ray Tube), a liquid crystal display (LCD), a plasma display or the like. In the display 7, a picture in which fish swim in a water tank or in the sea is displayed.

In the medal game apparatus 1 having the above arrangement, an operator who stands or sits in front of each place unit deposits a medal M, which the operator possesses, into the medal deposit hole 6 at an appropriate time, so that the thus-deposited medal M may hit the reciprocating target 2 when the largest numbers of fish are displayed on the display 7. The deposited medal M falls due to gravity, and while falling, the medal M hits the plurality of pins 10*a*, and its falling direction is changed. When, by chance, the reciprocating target 2 is located in the falling path of the thus-falling medal M, the medal M passes through in the right rear of the reciprocating target 2. A medal passing sensor 2*a* is provided in the right rear of the reciprocating target 2. When a medal passes through, the sensor 2*a* generates a medal detection signal.

This medal detection signal is input to a control circuit 50, described in detail below, provided inside the game apparatus 1, and thereby, the control circuit 50 generates a medal supply signal. The medal supply signal causes a medal supply mechanism, described in detail below, provided inside the apparatus 1 to operate, and thereby, the medal supply mechanism 30 supplies a predetermined number of medals M to a top portion of the falling face 10. The predetermined number of medals M thus supplied onto the medal falling face 10 fall along the falling face 10 due to gravity similarly to a medal M which is deposited by an operator.

When the medal M which was deposited through the deposit hole 6, falls along the falling face 10 and does not enter the reciprocating target 2, it falls directly onto the pusher table 3. A medal M, which once enters the reciprocating target, then, also falls onto the pusher table 3. When the pusher table 3 moves in the rear direction of FIG. 3 (*a*), a portion of the pusher table located in the rear side is received by a table receiving hole 10*c* (see FIG. 3 (*b*)) with the top surface of the pusher table 3 approximately coming into contact with a bottom end 10*b* of the falling face 10. At this time, when the medals are placed thereon, the medals are caught by the falling face 10 bottom, without being received by the table receiving hole 10*c* together with the pusher table 3, slide on the pusher table 3 and remain at the original position. As a result, the medals M on the pusher table 3 are pushed out to the front side (left side in FIG. 3 (*b*)).

As a result of medals M falling along the falling face 10 one after another, many medals M collect on the pusher table 3. As a result of the collecting medals being pushed out to the front side due to the forward and backward movement of the pusher table 3 as described above, some of those medals drop from the pusher table 3. The thus-dropping medals M fall onto the pusher field 4. Because the pusher table 3 performs the forward and backward movement on the pusher field 4, the medals M on the pusher field 4, located in the rear side, are pushed out to the front side (left side in FIG. 3 (*b*)) by a front end portion 3*a* of the pusher table 3 which performs the forward and backward movement. Thus, when many medals collect on the pusher field 4, the medal pushing action of the pusher table 3 causes a number of medals M to drop from the pusher field 4. The medals which thus drop from the pusher field 4 to the front side (left side in FIG. 3 (*b*)) enter an effective collection hole 4*a* provided therein. As a result, they fall due to gravity along a medal path provided inside the apparatus, and as a result, the medals M are ejected to the medal ejection pocket 5. The thus-ejected medals will be possessed by the operator at that place or position.

However, as shown in FIG. 3 (*b*), at the end of the front side (left side end in FIG. 3 (*b*)) of the pusher field 4, a medal holding plate 4*b* is provided. Thereby, medals M which were pushed out thereto cannot easily drop therefrom. Further, ineffective collection holes 4*c* are provided at the two sides of the pusher field 4. Although medals drop from the pusher field 4, when they enter the ineffective collection holes 4*c*, the medals pass a path, different from the path through which effective collection hole passed medals pass, enter a medal containing box inside the apparatus, and will be possessed by a manager of the game apparatus 1.

When a medal M falls along the falling face 10 and enters the reciprocating target 2, it is detected by the medal passing sensor 2*a*, and, as a result, a predetermined number of medals M are supplied to the falling face 10 top portion and the PTV display 7 clearly indicates to the operator that the medal M entered the reciprocating target 2, and also, displays a predetermined presentation program for the purpose of increasing the interest of the operator of the game apparatus 1.

Speakers 11 are provided to the game apparatus 1, and, in addition to the above-mentioned picture presentation operation through the display 7, a sound presentation operation is performed. Further, as shown in FIGS. 3(*a*) and 3(*b*), a thin water tank 13 is provided in front of the falling face 10. In FIG. 2(*b*), a distance between the rear surface of the water tank 13 and the falling face 10*a* is approximately 6 mm. Therefore, a medal M having the outer diameter of 24.2 mm falls, in a state in which the obverse of the medal is approximately parallel to the falling face 10, in a space between the falling face 10 and the water tank 13, hitting the pins 10*a* and changing its falling direction.

A pump 13*a* is provided below the water tank 13, and air is fed and supplies bubbles B in the water tank 13. As a result, when viewed from the front, as shown in FIG. 3 (*a*), it looks as if fish F displayed on the display 7 are swimming in the water tank 13. The falling face 10 is made of transparent glass or acrylic resin, and also, the water tank 13 is made of a transparent material. Thereby, it is also possible to set the falling face 10 in front of the water tank 13. Liquid to be filled in the water tank is not limited to water. For instance, it may also be oil. Further, as shown in FIG. 3(*b*), a transparent cover 12 is provided in front of the water tank 13 and the pusher field 4. Thereby, medal handling by a dishonest operator (for example, handling such as holding a medal M by hand, putting the medal M to the medal sensor 2*a*, and causing the sensor 2*a* to generate the medal supply signal or the like) can be prevented.

Figure 4:
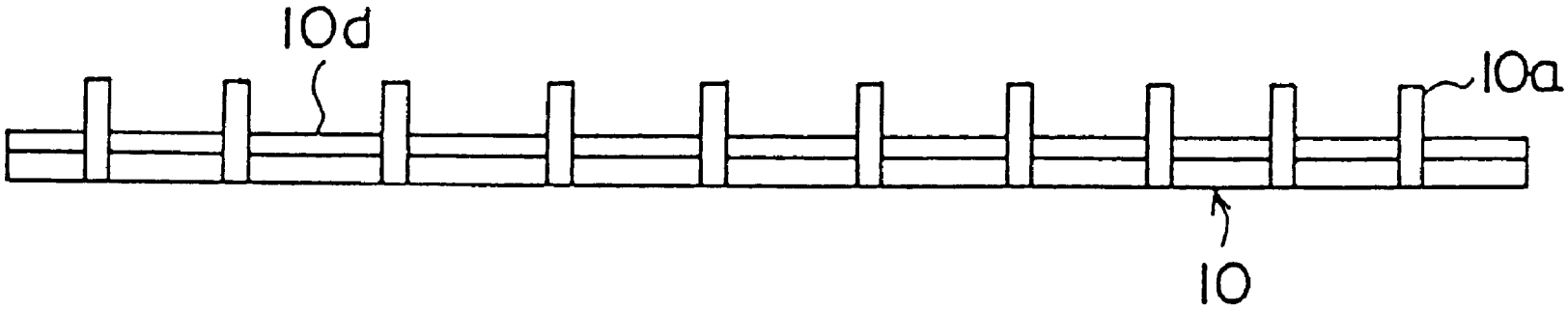
FIG. 4 is a side view of the falling face 10 of the medal game apparatus shown in FIG. 1.

As shown in FIG. 4, a transparent acrylic resin cover 10*d* is provided on the entirety of the surface of the above-mentioned transparent acrylic resin falling face 10. When a medal M falls along the falling face as described above, many medals fall, hitting the falling face. Thereby, the surface of the falling face 10 is likely to be damaged, and is likely to get dirty. When the falling face is damaged and gets dirty, it will be an obstacle when the rear display 7 is seen from the front side. However, it is costly to replace the entirety of the falling face 10, and the replacement work is troublesome. In order to solve such a problem, the transparent acrylic resin cover 10*d* is provided on the surface of the falling face 10. As a result, the acrylic cover 10*d* is damaged and get dirty due to repeated medal falling. When damaged and dirty, only the acrylic resin cover 10*d* is replaced. Thereby, the obstacle for the display 7 can be removed easily and with low cost.

Figure 5:
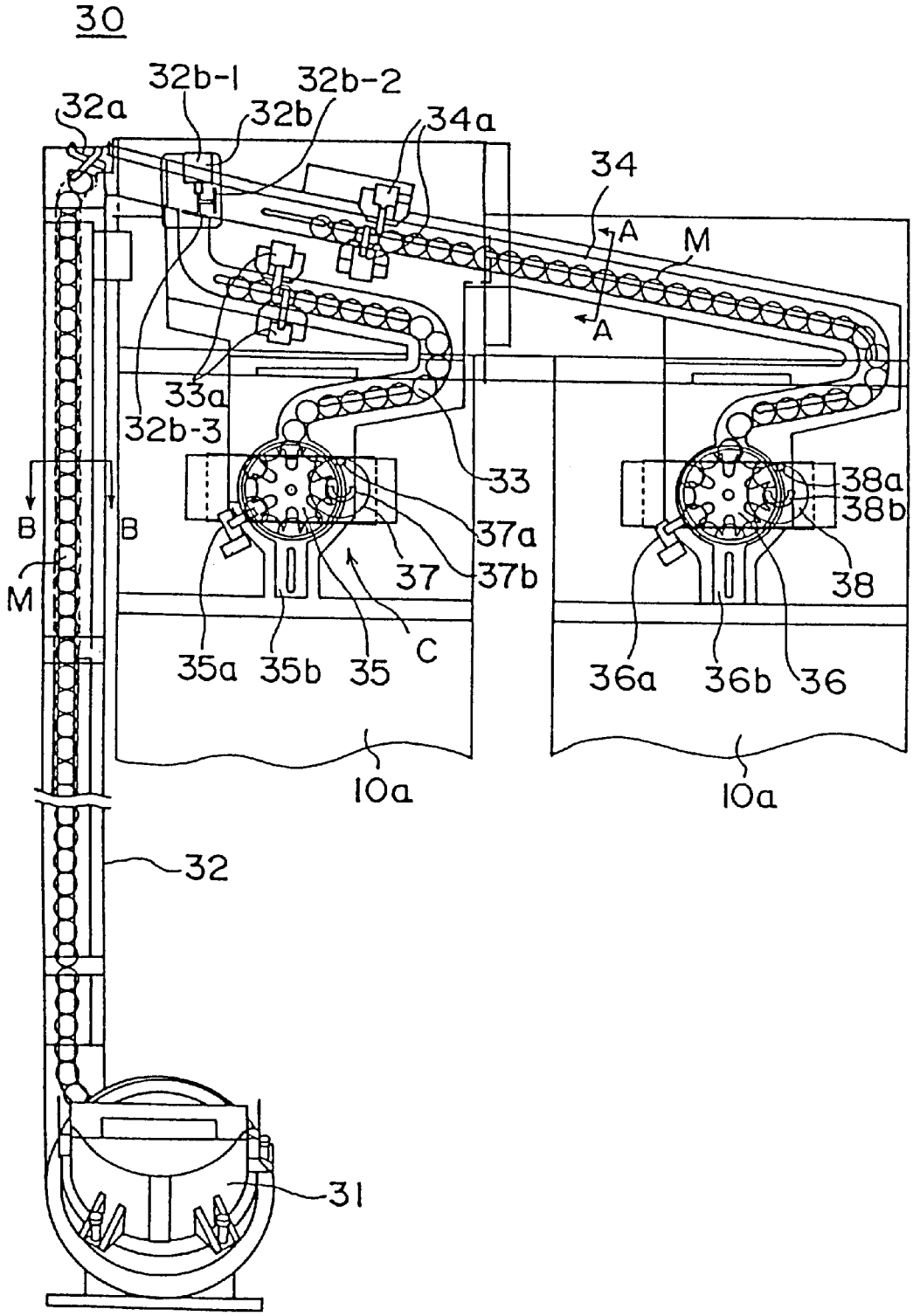
FIG. 5 is a front view of a medal supply mechanism which is provided inside the medal game apparatus shown in FIG. 1.
Figure 6A:
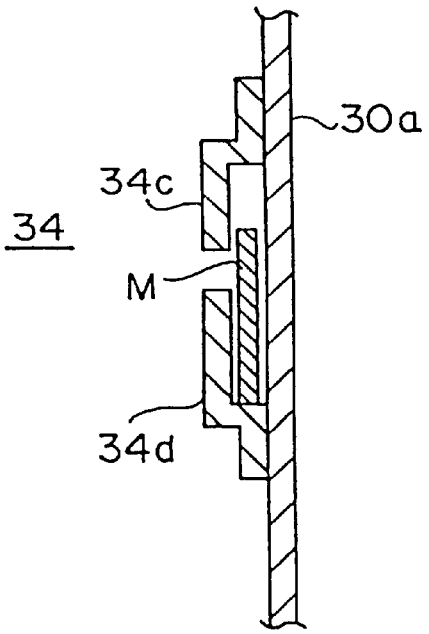
FIG. 6(*a*) is a sectional view of FIG. 5 of a second guiding path.
Figure 6B:
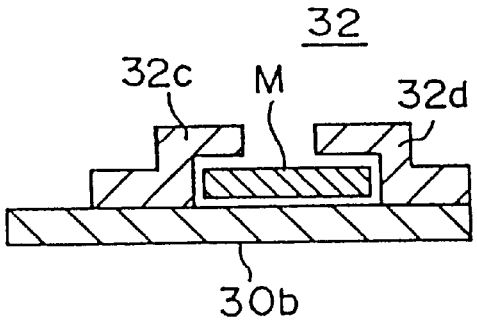
Figure 6C:
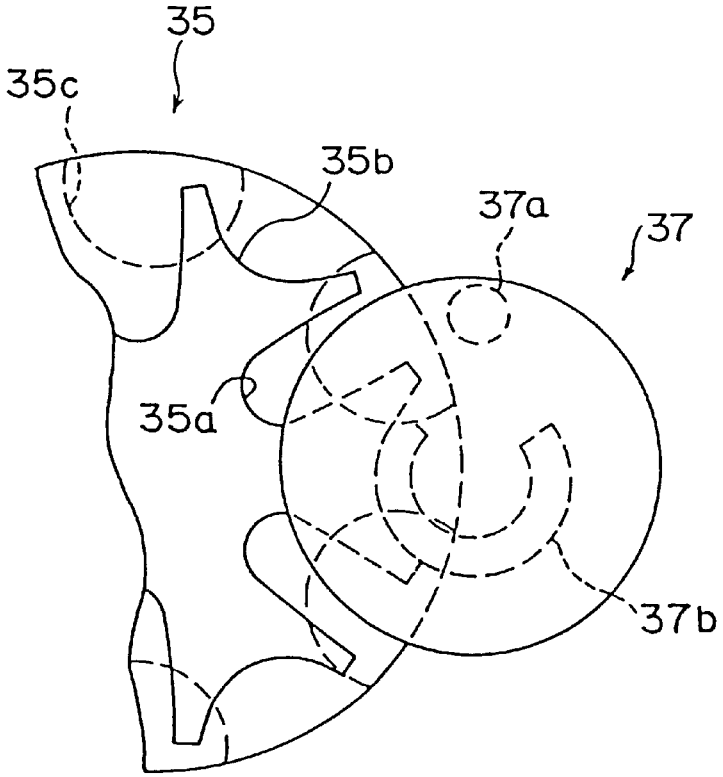

With reference to FIG. 5 and FIGS. 6(*a*), (*b*), and (*c*), the above-mentioned medal supply mechanism 30 will now be described. FIG. 5 shows the medal supply mechanism 30 which is provided for the right two units of the four place units shown in FIGS. 1 and 2. The medal supply mechanism 30 includes a pushing up hopper 31 which is provided in a lower part of the medal game apparatus 1 and pushes up medals M, and a rising guiding path 32 which guides the medal M pushed up by the pushing up hopper 31. The medals M rise, forming a row, and medals M which have been caused to rise by the rising guiding path 32 are distributed into a first guiding path 33 and a second guiding path 34 through a medal path changeover device 32*b*. The first guiding path 33 guides medals M to a first medal supply gear 35, and a second guiding path 34 guides medals M to a second medal supply gear 36.

Each of the medal supply gears 35 and 36 supplies medals which have been guided by the first and second guiding paths, one by one, to a respective one of the supply guiding paths 35*b* and 36*b*. The medals M, which have been thus supplied to the respective supply guiding paths 35*b* and 36*b*, are guided by the supply guiding paths 35*b* and 36*b*, and are supplied to the top of the falling faces 10 of the respective place units.

At the top of the above-mentioned rising guiding path 32, a rising medal empty sensor 32*a* is provided. Medals M pushed up by the pushing up hopper 31 move to the first and second guiding paths 33 and 34, respectively. When, as a result, a top portion of the rising guiding path 32 is empty, it is detected by the rising medal empty sensor 32*a*, and a detection signal thereof is transferred to the control circuit 50. As a result, the control circuit 50 drives the pushing up hopper 31 and pushes up medals M which collect in a lower part of the apparatus 1 so that the rising guiding path 32 is filled with medals M.

Each of the rising guiding path 32, and first and second guiding paths 33 and 34 has a structure as shown in FIGS. 6(*a*) and (*b*). Guiding plates 32*c*, 32*d*, 34*c* and 34*d* are fixed onto the supporting plates 30*a*, 30*b*, and thereby, each medal guiding path is defined. Because the cross section of the first guiding path 33 is identical to the cross section of the second guiding path 34, it has been omitted from the figures. Further, the supply guiding paths 35*b*, 36*b* have similar cross sections.

At the top of each of the first and second guiding paths 33, 34, and a respective one of first medal empty sensor 33*a* and a second medal empty sensor 34*a* are provided. By an operation of any one of the medal supply gears 35, 36, medals collecting in the corresponding one of the guiding paths 33 and 34 are supplied through the corresponding one of the supply guiding paths 35*b* and 36*b*. Thereby, when the top of a guiding path is empty, the corresponding one of the sensors 33*a* and 34*a* detects it. A detection unit is then transferred to the control circuit 50, and the control circuit 50, as a result, changes over the medal supply changeover device 32*b* so that medals are supplied to the guiding path whose top is empty. Further, the pushing up hopper 31 is driven, and medals are pushed up. The pushed up medals pass through the medal path changeover device 32*b*, and are supplied to the guiding path whose top is empty. Thereby, the guiding path is filled with medals.

The medal rising empty sensor 32*a* comprises an arm, the center of which is rotatably supported through a shaft. When a medal M is present at the top of the rising guiding path 32, the extending end of the arm is lifted by the medal, and when no medal M is present at the top of the rising guiding path 32, it is lowered. A sensor which uses the photo-interrupter principle is provided at the extending end portion of the arm of the state in which the extending end of the arm is lifted as mentioned above. The sensor detects that light is blocked by the extending end of the arm. Thereby, it is possible to detect the state in which the arm is lifted and the state in which the arm is lowered. Thereby, it is possible to detect whether or not a medal is present at the top of the rising guiding path 32.

Similarly, each of the first and second medal empty sensors 33*a* and 34*b* uses the photo-interrupter principle, and they detect that light is blocked directly by a medal. Each of the first and second medal empty sensors 33*a*, 34*b* comprises two sets of sensors, as shown in the figure. Specifically, the first medal empty sensor 33*a* comprises two sensors which are arranged at the front and rear along the guiding path 33. Similarly, the second medal empty sensor 34*a* comprises two sensors which are arranged at the front and rear along the guiding path 34. By thus providing two sensors, even if a space between two side-by-side arranged medals blocks the light path of one sensor, the light path of the other sensor is blocked by one of the two medals. Thus, it is possible to positively detect medals.

The medal supply gears 35, 36 have the same configurations. Therefore, only the medal supply gear 35 will now be described. The medal supply gear has a disc-like outline shape, and, as shown in FIG. 6 (*c*), on one surface thereof, a plurality of engagement grooves 35*a* and sliding portions 35*b* are arranged alternately along a circumference. On the other surface, a plurality of medal fitting grooves 35*c* are provided along a circumference. A Geneva gear 37 (a Geneva gear 38 corresponding to the medal supply gear 36) is provided adjacent to the medal supply gear 35. The medal supply gear 35 is driven by the Geneva gear 37 according to the well-known Geneva drive principle. Specifically, the Geneva gear 37 rotates at a fixed rotation speed clockwise in FIG. 5, and a driving pin 37*a* (a driving pin 38*a* in the Geneva gear 38), which stands perpendicularly, rotates. The thus rotating driving pin 37*a* enters the engagement groove 35*a* of the plurality of engagement groove 35*a* of the medal supply gear 35, which faces the driving pin 37*a*. The driving pin 37*a* pushes an internal wall of the engagement groove 35*a* and thereby drives the medal supply gear 35 so that the medal supply gear 35 may rotate counterclockwise. Thus, after the medal supply gear 35 has rotated approximately 60 degrees, the driving pin 37*a* goes out from the engagement groove 35*a*. Then, as the Geneva gear 37 rotates, an arc portion 37*a* (an arc portion 38*b* in the Geneva gear 38), which is provided on the same surface of the Geneva gear 37, comes into contact with the facing sliding portion 35*b* of the medal supply gear 35, and slides on the sliding portion 35*b*, while the medal supply gear 35 is not driven, and the rotation angle position of the medal supply gear 35 is maintained as it is. After the Geneva gear 37 further rotates, the arc portion 37*a* separates from the sliding portion 35*b*, and the driving pin 37*a* again enters the subsequent engagement groove 35*a*.

Thus, as the Geneva gear 37 performs specific rotation, the medal supply gear 35 gradually rotates, repeating an operation in which the medal supply gear 35 rotates again approximately 60 degrees, stops for a while, and then again rotates approximately 60 degrees. By such rotation of the medal supply gear 35, while the medal supply gear 35 stops, a medal M drops into the highest medal fitting groove 35*c* from the first guiding path 33. By rotation of the medal supply gear 35, the subsequent medal fitting groove 35*c* moves to the highest portion, that is, moves to the position at which the bottom end of-the first guiding path 33 faces. As a result, a subsequent medal M drops to the medal fitting groove 35*c* which has been moved to the highest portion from the first guiding path 33. Such an operation is repeated, and thus, a medal M which has dropped to the medal fitting groove 35*c* at the highest portion moves downward gradually.

At the bottom-left, in FIG. 5, of the medal supply gear 35, a medal count sensor 35*a* (for the medal supply gear 36, a medal count sensor 36*a*) is provided. This uses the photo-interrupter principle, and presence of a medal is detected as a result of the light path of the sensor being blocked by the medal. While the medal supply gear stops, one of the medal fitting grooves 35*c* exactly faces the sensor 35*a*. Therefore, a medal, which is gradually moved downward by rotation of the medal supply gear 35, is detected by the sensor 35*a* while the medal supply gear 35 stops. Then, when the medal supply gear 35 rotates subsequently, a gap to a medal M fitted in the subsequent medal fitting groove 35*c* is located on the light path of the sensor 35*a*. Then, the medal fitted in the above-mentioned subsequent medal fitting groove 35*c* blocks the light path of the sensor 35*a*. Thus, each time a medal M passes through the sensor 35*a*, the light path of the sensor 35*a* is blocked and not blocked occur alternately. By detecting such alternate occurrences of the two different states, the number of medals M that have passed through the sensor 35*a* can be counted.

Through such an arrangement of the rising guiding path 32, first and second guiding paths 33, 34, and medal supply gears 35, 36, medals M are pushed up, with a specific orientation in which the obverses thereof are maintained parallel to the surface of FIG. 5, that is, they are parallel to the surface of the falling face 10, and are carried to the medal supply gears 35, 36 right above the falling faces 10 of the left and right place units. Further, through the medal supply gears 35, 36 and the following supply guiding paths 35*b*, 36*b*, they are supplied to the falling faces 10, the orientation thereof being maintained as they are. Thereby, it is possible to make the medal supply mechanism thinner. Further, because it is possible to position medals M so that they are always in a right orientation to the falling faces 10, it is possible to prevent a situation in which the falling face 10 is blocked with medals M.

The Geneva gears 37, 38, which drive the medal supply gears 35, 36, respectively, are driven by driving motors which are not shown in the figure. Through the Geneva gear principle, the medal supply gears 35, 36 are intermittently rotated 60 degrees each as mentioned above, by continuous fixed-speed rotation of the respective Geneva gears 37, 38. However, there are many cases where, due to the inertia of the medal supply gears or the like, it is difficult to cause them to always rotate intermittently 60 degrees each. When a situation occurs in which the rotation of the medal supply gears 35, 36 is not controlled within 60 degrees each regularly, and, due to inertia or the like, an extra rotation occurs, an extra number of medals M may be supplied to the falling faces 10. In order to prevent such a situation from occurring, a brake mechanism is provided for each of the motors for driving the Geneva gears 37, 38. By a function of the control circuit 50, the brake mechanisms brake the Geneva gear driving motors each time the medal supply gears 35, 36 rotate 60 degrees through the Geneva gears 37, 38, thereby forcibly causing them to stop, and, as a result, causing rotation of the Geneva gears to be stopped. As a result, each medal supply gear 35, 36 positively stops each time it rotates 60 degrees. Thus, a situation can be prevented from occurring in which the extra rotation occurs due to inertia or the like, and, as a result, an extra number of medals M are supplied to the falling faces 10.

Figure 7:
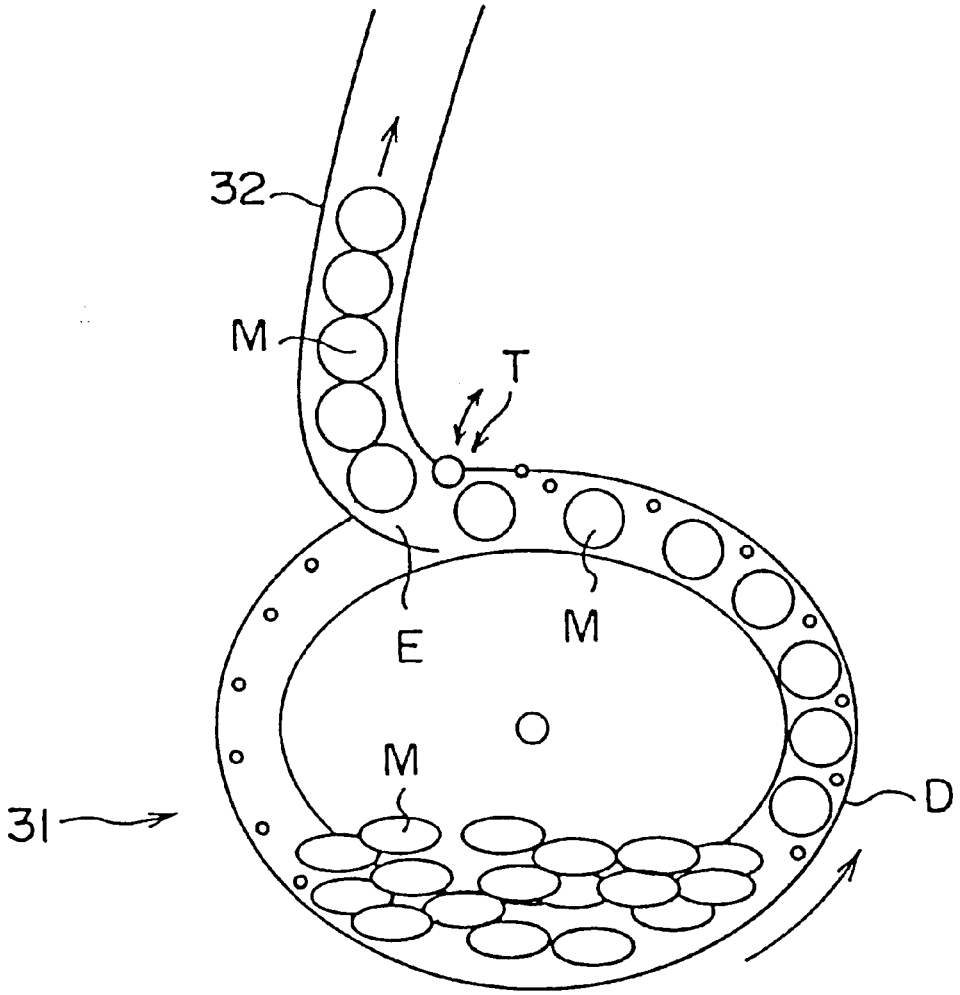
FIG. 7 shows a pushing up hopper.

The above-mentioned pushing up hopper 31 has approximately a configuration such as that shown in FIG. 7. It has a ring-like shape, and, as shown in FIG. 5, is set obliquely. A drum D, which rotates counterclockwise in FIG. 7, puts medals M, which are collected in the bottom, on a ring thereof, one by one, and, due to rotation thereof, carries them to a position of a bottom end portion E of the rising guiding path 32. Medals M, which have reached the bottom end portion of the rising guiding path 32, are pushed into the bottom end portion E of the rising guiding path due to the rotation of the drum D, and caused to rise, being guided by the rising guiding path 32. A stopper T, for preventing medals which have been pushed in the bottom end portion E from flowing backward, is provided adjacent to the bottom end portion E. As a pushing hopper 31 having the above-described configuration, MODELDH-750/U1 of Asahi Seiko Co. Ltd., for example, can be used.

Figure 8:
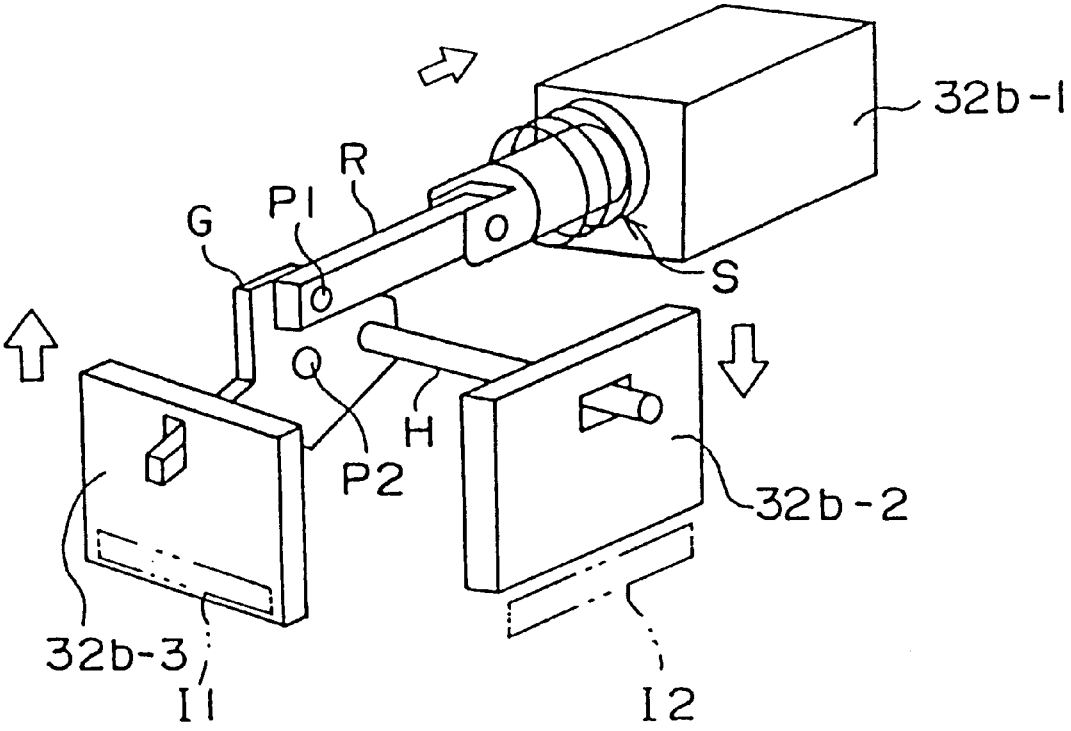
FIG. 8 is a perspective view showing a medal path changeover portion.

The medal path changeover portion 32*b* has approximately a configuration such as that shown in FIG. 8. A rod R is pushed out in a forward direction by a coil spring S and is withdrawn when a solenoid 32*b*-1, which is substantially fixed to the apparatus 1, is excited against the force of the spring S, backward, that is, toward the solenoid 32*b*-1 side, in a direction of an arrow. At the extending end of the rod R, a rotation member G is rotatably supported at a first supporting point P1. The rotation member G is also rotatably supported on a second supporting point P2, which is substantially fixed to the apparatus 1. At a front side of the rotation member G, a first sluice plate 32*b*-3 is rotatably supported, and, at a lateral side thereof, a second sluice plate 32*b*-2 is also rotatably supported via a supporting pole H, which is provided to stand perpendicularly.

The state shown in FIG. 8 is, as shown in the figure, a state in which an entering hole I1 to the first guiding path 33 is shut by the first sluice plate 32*b*-3, and the second sluice plate 32*b*-2 is removed from an entering hole I2 to the second guiding path 34. In FIG. 5, the medal path changeover portion 32*b* of the configuration of FIG. 8 is set so that the rod R projects in the downward direction of FIG. 5, the first sluice plate 32*b*-3 is along a direction in which the second guiding path 34 extends to the bottom-right, and the second sluice plate 32*b*-2 is vertical. A guiding structure, which is not shown in the figures, is provided so that each of the first and second sluice plates is movable only in a vertical direction of FIG. 8, that is, in an arrow direction of the figure. Thereby, corresponding to the forward and backward movement of the rod R, the rotation member G rotates along the rear direction of FIG. 5, and, as a result, the first and second sluice plates also move in the rear direction of FIG. 5.

When the solenoid 32*b*-1 is excited, the rod R is withdrawn toward the solenoid 32*b*-1, and as a result, the rotation member G is rotated, and the first sluice plate 32*b*-3 moves in the upward direction of FIG. 8, that is, in the front direction of FIG. 5, and, thereby, the first entering hole I1 to communicate with the first guiding path 33 is opened.

Simultaneously, the second sluice plate 32*b*-2 moves downwardly in FIG. 8, that is, in the rear direction of FIG. 5, and, thereby, the entering hole I2 to communicate with the second guiding path 34 is shut. Thus, by switching excitation of the solenoid 32*b*-1, the medal path changeover portion 32*b* causes the respective sluice plates 32*b*-2, 3 to move, and thereby, shuts/opens the entering holes I1, I2 to communicate with the first and second guiding paths 33, 34. Thereby, medals M which have been caused to rise along the rising guiding path 32 are guided either to the first guiding path.33 or the second guiding path 34, when needed.

Figure 9:
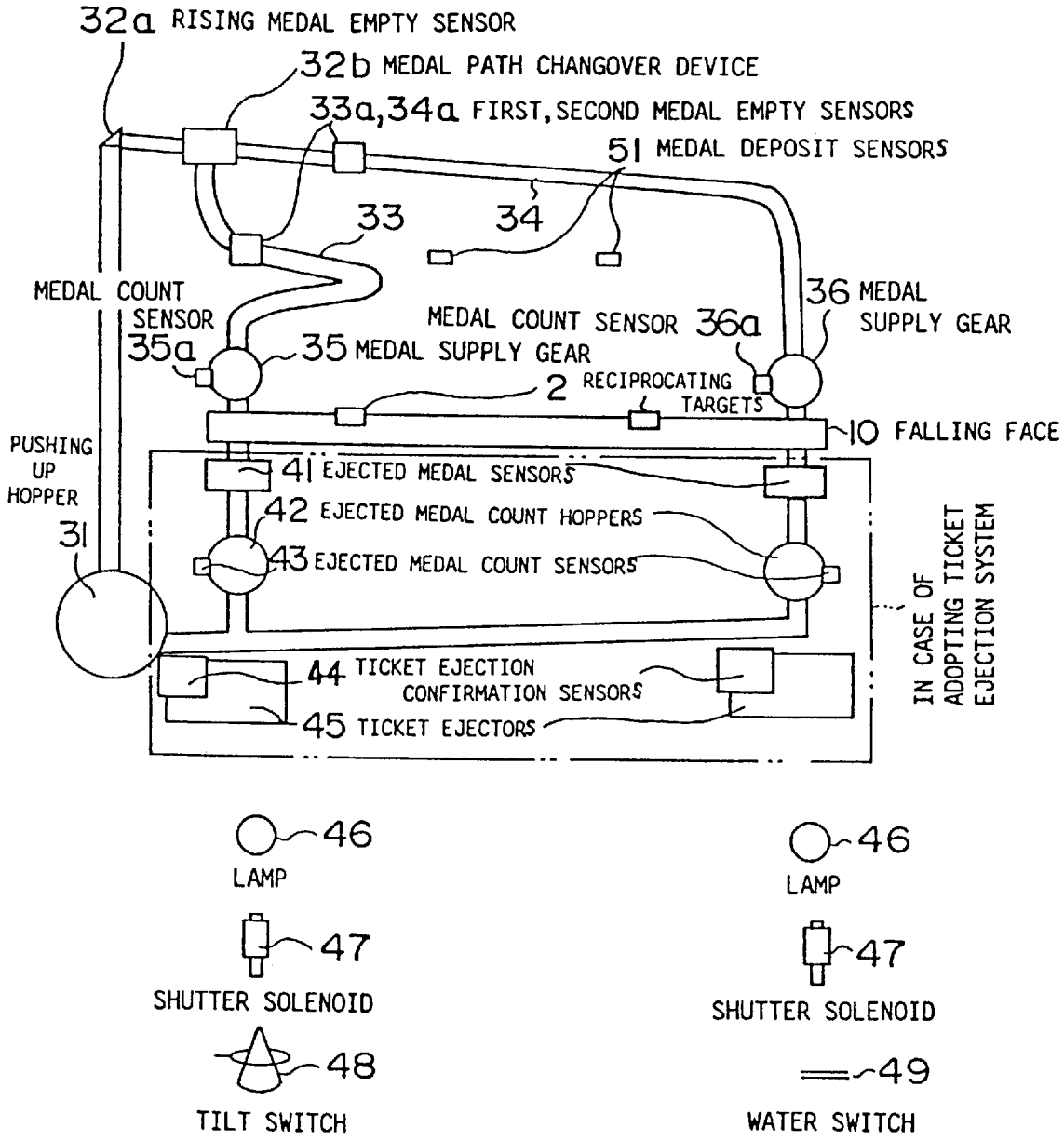
FIG. 9 is a view showing elements which relate to a control system of the medal game apparatus of FIG. 1.

With reference to FIGS. 9, 10 (*a*), 10 (*b*), 11, 12, 13 and 14, a control system of this medal game apparatus 1 will now be described. FIG. 9 typically shows respective elements, for two place units, relating to the control system, included in the game apparatus described above. However, in FIGS. 9, 10 (*a*), (*b*), and 11, components associated with ticket ejectors 45 are added. The ticket ejectors 45 are configured for enabling an operation which will now be described. Instead of having the medals M, which have dropped from the pusher field 4 to the effective collection hole 4*a*, ejected to the medal ejection pockets 5 as described above, a ticket is ejected, which indicates the number of the medals expected to be ejected. In this case, the medal ejection pockets 5 shown in FIG. 2 function as the ticket ejectors 45.

In order to enable such an operation, other than the ticket ejectors 45, ejected medal sensors 41, ejected medal count hoppers 42, ejected medal count sensors 43 and ticket ejection confirmation sensors 44 are provided. Medals M, which have dropped from the pusher field 4 to the effective collection hole 4*a*, pass through the ejected medal sensor 41 of the place or position, which uses the photo-interrupter principle and detects the passing through as a result of the medals M blocking the light path when passing therethrough. When the passing through of the medals M is detected by this sensor 41, under control of the control circuit 50, the ejected medal count hopper 42 of the place or position is driven to rotate. This hopper 42 has a configuration similar to the hopper 31 shown in FIG. 7. However, in this case, the count hopper 42 is not used to push up medals M but is used for counting the number of medals M which pass therethrough. For each count hopper 42, an ejected medal count sensor 44 is provided, which uses the photo-interrupter principle and detects the passing through as a result of medals M blocking the light path when passing therethrough. Similar to the counting by the medal count sensors 35*a*, 36*a* described above, this counts the number of medals M which have passed through the sensor 43 by detecting that the light path of the sensor 44 is blocked and not blocked alternately each time a medal M passes through the sensor 43. The number of medals M which have been thus counted is printed on a form for a predetermined ticket under control by the control circuit 50, and a number of tickets, corresponding to the number of medals M expected to be ejected, are ejected to the ticket ejectors 45 of the place or position.

A medal deposit sensor 51 is provided to the medal deposit holes 6 of each place unit. Through the sensors 51, the fact that medals are deposited to the game apparatus 1 and the number of medals deposited can be always recognized by the control circuit 50. Thereby, when a medal M is deposited to the falling face 10 (which looks as if it was under water as a result of water in which fish swim being displayed by the display 7 on the background), it is possible to increase an operator's interest by causing a sound effect "plop" to be generated from speakers 11 through a software program of the control circuit 50. Alternatively, and combined therewith, it is also possible to further increase an operator's interest, by causing the fish displayed on the display 7 to react through a software program of the control circuit 50.

Further, with the number of deposited medals M obtained using the sensors 51, and the number of medals M provided to an operator from the game apparatus obtained using the above-mentioned medal count sensors 43 (as a result of tickets, in which the number is indicated, being ejected), it is always possible to obtain a ratio between the deposited medal number and the ejected medal number, namely, a medal in-and-out ratio as an actual result. By obtaining such a medal in-and-out ratio, it is possible to control the size and the number of fish which are displayed on the display 7 so that the medal in-and-out ratio may be a value within a range.

Figure 14:
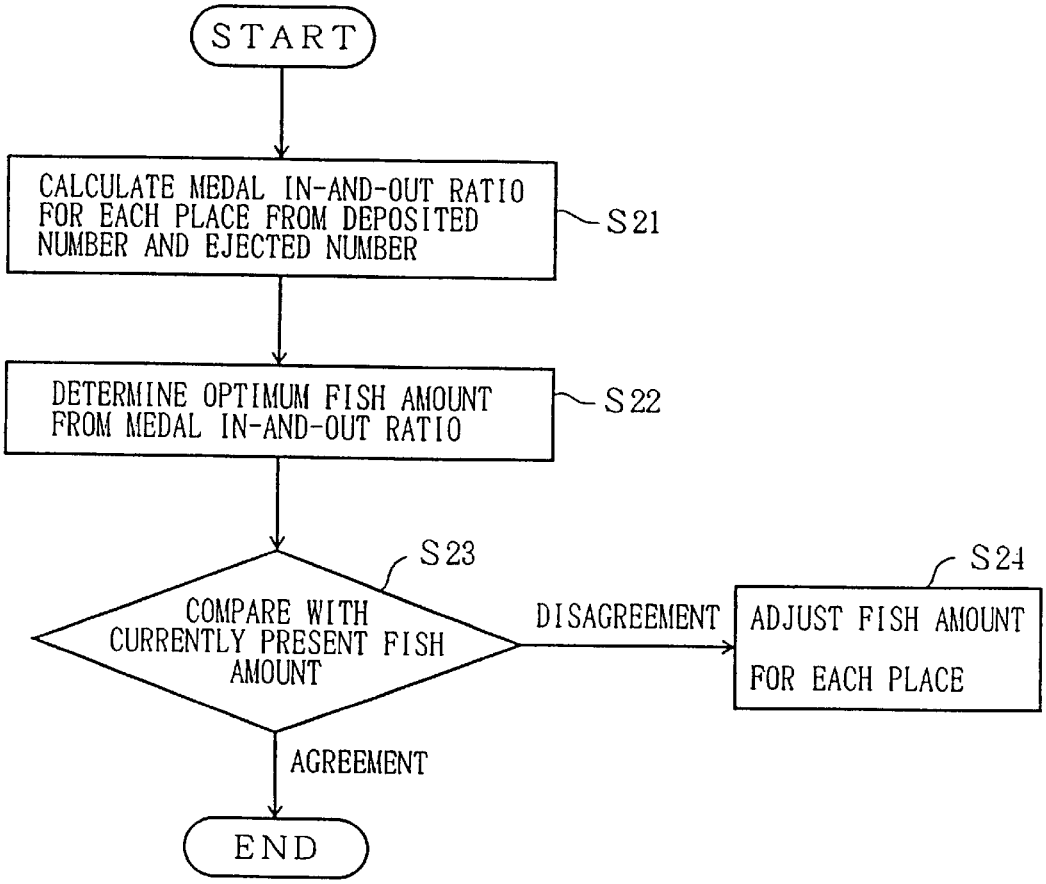
FIG. 14 is a flowchart showing a process for determining a number of fish to be displayed on the display of the medal game apparatus of FIG. 1.
Figure 15:
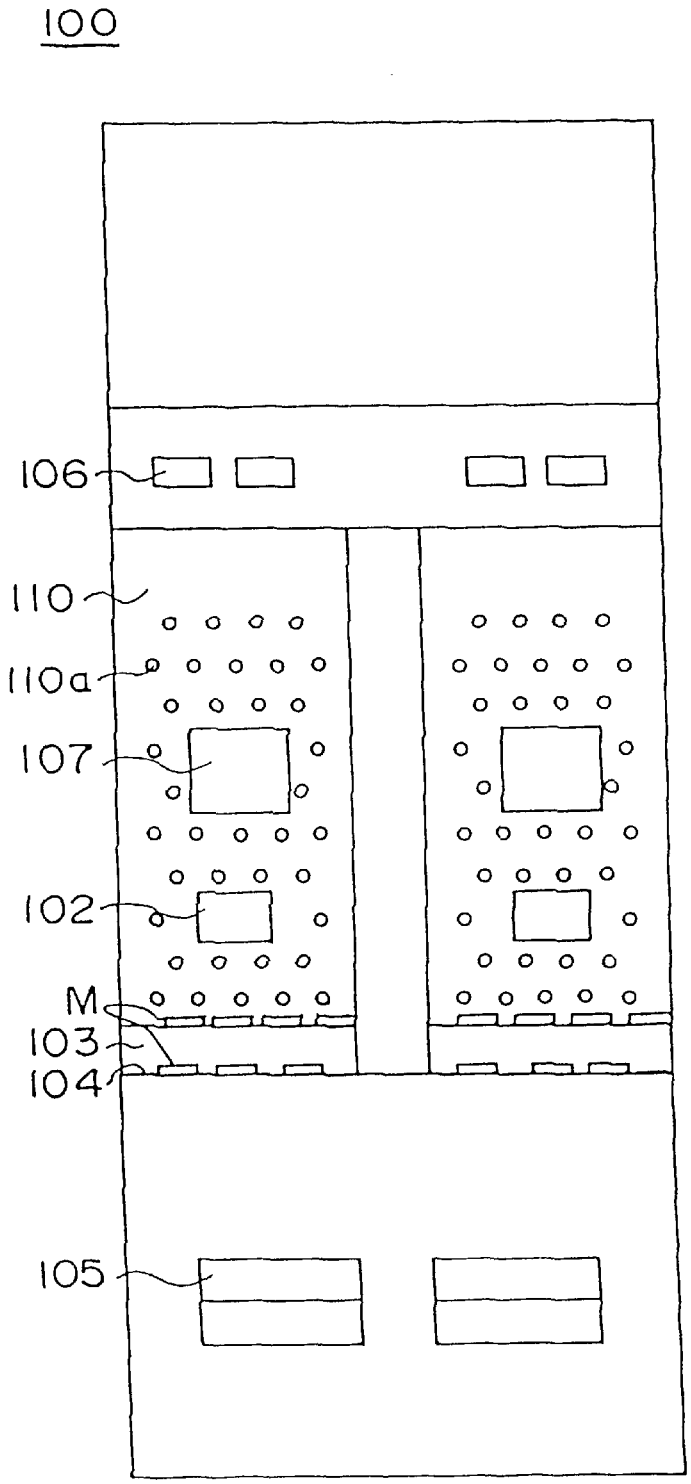
FIG. 15 is a front view of a prior art medal game apparatus.

Specifically, for example, an operation shown in FIG. 14 is performed by the control circuit 50. That is, in a step S21 (hereinafter, the term "step" being omitted), by dividing the medal deposited number by the medal ejected number, as the number in the aggregate within a past fixed period, for each place unit, the medal in-and-out ratio as an actual result in the place in the period is calculated. In S22, a fish amount (the number of fish times a size of the fish, hereinafter, in the same way) corresponding to the medal in-and-out ratio is determined. Specifically, when the thus-calculated medal in-and-out ratio is very large, the optimum fish amount of the place or position is determined to be a relatively small amount. Inversely, when the thus-calculated medal in-and-out ratio is very small, the optimum fish amount of the place or position is determined to be a relatively large amount. The control circuit 50 controls so that the number of medals which are, as described above, supplied to the falling face of the place when a medal enters the reciprocating target 2 in each place may be larger as the amount of fish which are displayed in front of the place is larger, and, inversely, the number of medals may be smaller as the amount of fish is smaller. Therefore, it is possible to cause an average medal in-and-out ratio in each place to be approximately constant by determining the optimum fish amount in S22.

In S23, for each place, the thus-obtained optimum fish amount is compared with the amount of fish which are actually displayed in front of the place. If the result is approximately in agreement, it is not necessary to specially control the amount of fish displayed on the display 7. However, if the result is considerably different, from data of the difference between the optimum fish amount in each place and the amount of fish actually displayed in front of the place, synthetically judging an amount of fish to be displayed on the entirety of the display 7, the optimum amount of fish to appear on the display 7 and optimum movement of the fish on the display 7 are determined in S24. As a result, it is possible to cause an average medal in-and-out ratio to be approximately constant in each place, as mentioned above.

A presentation lighting (lamps) 46 shown in FIGS. 9 and 10(*a*) is, as shown in FIG. 2, provided at a top portion of the apparatus 1, and, in addition to a presentation effect by the display 7, is caused to always create a predetermined illumination effect, and/or performs lighting operation so as to create a special illumination effect, when a medal M enters the reciprocating target of a place unit, so that it is possible to further increase an operator's interest.

Further, a water switch 49 (see FIGS. 9, 10 (*a*)) is provided for detecting water leakage from the water tank 13, which is provided in front of or in rear of the falling face 10 of each place, and, when a water leak is detected thereby (in order to prevent a situation in which the control circuit 50 or the like is splashed and performs an erroneous operation such as to supply extra medals, and, as a result, extra medals are ejected), it stops excitation of a shutter solenoid 47, which is usually excited, causes a shutter (not shown in the figures), which is provided to the medal ejection pocket 5 or the ticket ejector 45, to operate, and prevents either medals M or tickets from being ejected.

Further, a tilt switch 48 (see FIGS. 9, 10 (*a*)) is provided in this game apparatus, so that it detects when the game apparatus is intentionally tilted by an unfair operator (for example, so that more medals M may enter the effective collection hole 4*a* from the pusher field 4), and it stops excitation of the shutter solenoid 47, which is usually excited, and causes a shutter (not shown in the figures), which is provided to the medal ejection pocket 5 or the ticket ejector 45, to operate, and prevents medals M from being ejected, under control by the control circuit 50. In a case where the ticket ejector is used, because a shutter is provided in front of the medal count hopper 42, medals are not counted, and thereby a corresponding number of tickets are prevented from being ejected.

Further in a case, other than that mentioned above, where power is not supplied to the apparatus 1, excitation of the shutter solenoid 47 is stopped, the shutters (not shown in the figures) provided in either the medal ejection pocket or the ticket ejector 45 are operated, and either medals M or tickets are prevented from being ejected.

Further, as shown in FIG. 10(*b*), power is always supplied to one of the lighting 46 so that it is always lit. Additionally, power is always supplied to the mechanism which performs regular reciprocation operation of the pusher table 3 of each place unit, to mechanism 2*b* which performs a regular reciprocation operation of the reciprocating target 2 of each place unit, to the above-mentioned pump 13*a* driving motor for producing bubbles in the water tank 13, and to a mechanism 52 for filtering and circulating water in the water tank 13 in order to prevent the water from becoming dirty. Accordingly, regular operations thereof are carried out.

Figure 11:
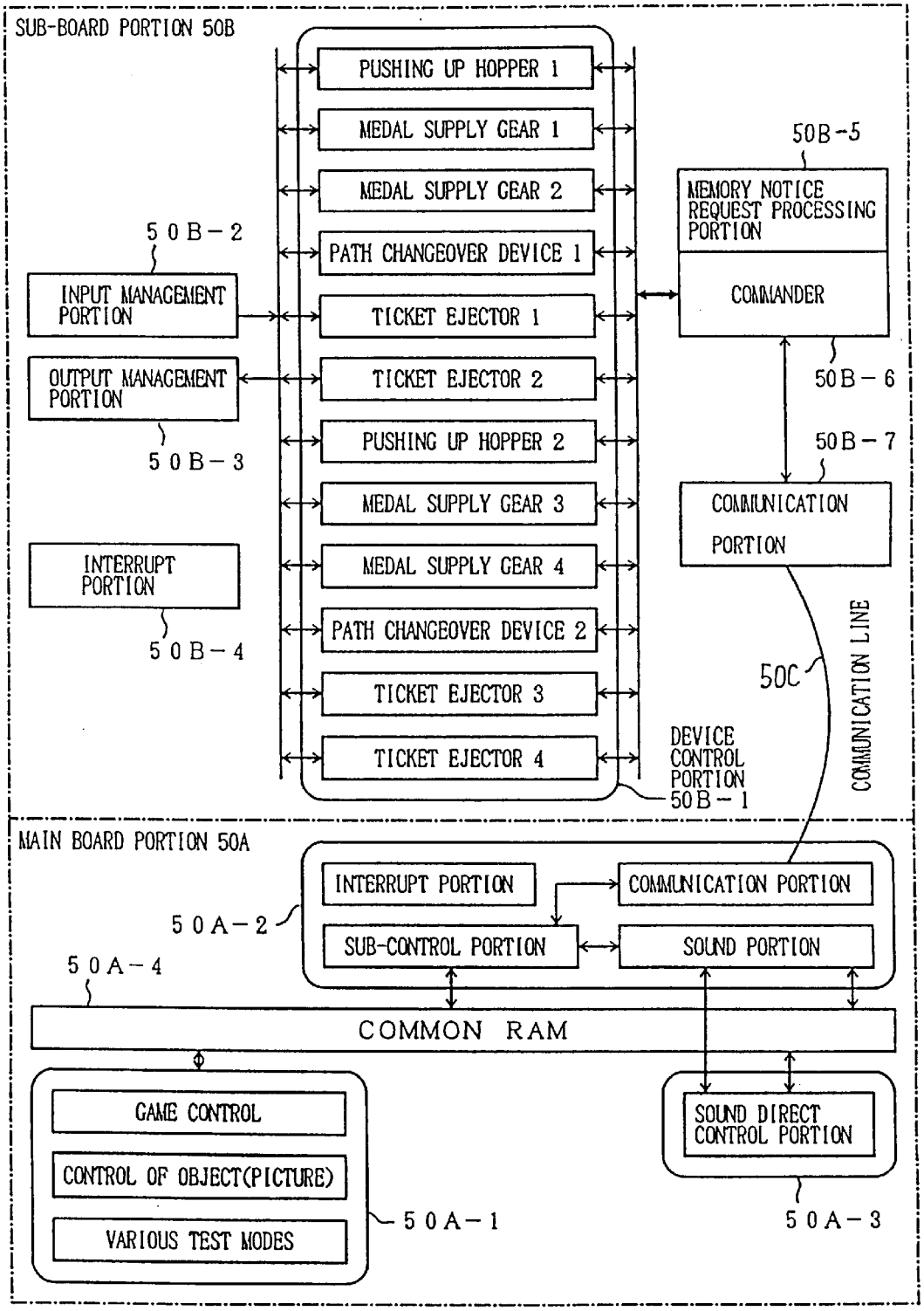
FIG. 11 is a view showing an internal arrangement of the control circuit of FIG. 10.

FIG. 11 shows an internal configuration of the control unit 50 shown in FIG. 10(*a*). The control circuit 50 generally controls the entirety of the apparatus 1, and comprises a main board portion 50A, which controls display contents of the display 7, and a sub-board portion 50B, which controls the mechanical mechanism portion of the apparatus 1.

The sub-board portion SOB includes a device control portion 50B-1, which comprises subroutine software programs that make respective mechanisms become intelligent individually and controls them. These subroutines include a pushing up hopper 1 (the pushing hopper 31 for the left-side two place units shown in FIG. 2) subroutine, a medal supply gear 1 (the medal supply gear 35 of the left most place unit) subroutine, a medal supply gear 2 (the medal supply gear 36 of the second-from-the-left place unit) subroutine, a path changeover device 1 (the medal path changeover device 32*b* for the left-side two plate units of FIG. 2) subroutine, a ticket ejector 1 (the left most place unit ticket ejector 45) subroutine, a ticket ejector 2 (the ticket ejector 45 of the second-from-the-left place unit) subroutine, a pushing up hopper 2 (the pushing up hopper 31 for the right-side two place units of FIG. 2) subroutine, a medal supply gear 3 (the medal supply gear 35 of the second-from-the-right place unit) subroutine, a medal supply gear 4 (the right most place unit medal supply gear 36) subroutine, a path changeover device 2 (the medal path changeover device 32*b* for the right-side two place units of FIG. 2) subroutine, a ticket ejector 3 (the ticket ejector 45 of the second-from-the-right place unit) subroutine and a ticket ejector 4 (the ticket ejector 45 of the right most place unit).

To make something become intelligent means to configure software programs so that the above-mentioned particular mechanisms can be, in principle, independently controlled, as it is associated with an operation of another mechanism when it is needed, by, for example, providing a special subroutine for each, as mentioned above. In other words, to make something become intelligent is to provide special subroutines which control input/output necessary for causing particular mechanisms to operate, and to configure software programs so that a mechanism and a control software program can be treated as one means. The purpose of thus making them become intelligent is to attempt simplification of control by configuring so that a mechanism and a control software may be combined and function as a separate means, and to enable re-execution and returning operation upon occurrence of trouble to be easily performed.

Further, an input management portion 50B-2 and an output management portion 50B-3 manage transfer of a signal which is output from each subroutine and a signal which is input to each subroutine in the timing of an interrupt pulse, which is supplied by hardware every 2 milliseconds, and the process of taking measures for preventing the occurrence of noise, which is referred to as chattering, and thereby, allows the signal transfer to be smoothly performed. An interrupt portion 50B-4 is a software program, and has jobs written therein which are started by input of the above-mentioned interrupt signal. A memory notice request processing portion 50B-5 processes a read request (specifically, a request by the main board 50A for monitoring the state of each mechanism which is controlled by each subroutine of the device control portion 50B-1). Further, a commander 50B-6 appropriately analyzes commands which are provided by the main board 50B, and transfers the commands to each subroutine appropriately so that the commands are smoothly executed by each mechanism which is controlled by each subroutine of the device control portion 50B-1. Specifically, the commander 50B-6 converts a large division command into particular small division commands, and supplies them to corresponding particular units of the device control portion 50B-1. A communication portion 50B-7 controls communications between the main board 50A and the sub-board 50B.

The main board 50A includes a main control portion 50A-1, an input/output control portion 50A-2, a sound direct control portion 50A-3, and a common RAM 50A-4. The main control portion 50A-1 generally controls game operations in the game apparatus 1, and, for example, when receiving information that a medal entered the reciprocating target of a place unit, determines the number of medals to be supplied to the falling face 10 of the place unit, controls movement of the fish displayed on the display 7, and outputs commands to the sub-board 50B for appropriately controlling an operation of each mechanism in synchronization with movement of the fish. Further, while controlling, it simulates actual fish movement so that the movement of the fish which is determined by the above-described operation flow of FIG. 14 may be implemented. Further, it controls so that the fish movements look real, by appropriately changing a pattern to be displayed on the display 7 according to the respective movements of the fish (ordinary swimming movement, a movement of eating food, a movement of going toward the water surface after eating food, and so forth). For example, as a pattern of moving the fish three-dimensionally, a pattern of specifying a target position and controlling movement of the fish so as to go there, a pattern of specifying angular coordinates and controlling a movement of the fish so as to go there, and so forth can be considered.

The sound direct control portion 50A-3 directly controls sound which is generated in the speakers 11. The control of sound produces, for example, background music, the sound effect of a "plop" when a medal is deposited to the falling face 10 by an operator, a water sound of fish eating food and jumping up to the water surface and water sound of the fish then falling down to the water surface when many medals are supplied to the falling face at a stretch as a result of a medal entering the reciprocating target 2, and a water sound in case a predetermined number of medals are supplied to the falling face simultaneously. By adding such sound control, it is possible to further effectively increase an operator's interest.

The input/output control portion 50A-2 has a function for enabling communications with the sub-board 50B to be easily performed. Further, an interrupt portion in the input/output control portion 50A-2 is a software program, and contains each job which is started by input of an interrupt pulse which is generated by hardware every 2 milliseconds and each job which is started by input of an interrupt pulse of 1/60 seconds (16.7 milliseconds) for scanning control of the display 7.

Further, the input/output control portion 50A-2 includes a communication portion which is connected with a communication portion 50B-7 of the sub-board 50B through a communication line 50C, and performs communications between the main board 50A and the sub-board 50B. Further, it includes a sub-control portion which has functions of, appropriately, communicating a command from the main control portion 50A-1 to the sub-board 50B, communicating a command from the main control portion 50A-1 to a sound portion in the same input/output portion 50A-2, and, conversely, reporting state indicating information from the sub-board 50B to the main control portion 50A-1. The above-mentioned sound portion included in the input/output portion 50A-2 has a function of transferring of a desired sound effect waveform to a waveform memory in response to a request from the sound direct control portion 50A-3.

The common RAM 50A-4 in the main board 50A is used in information communication between three CPUs of the main control portion 50A-1, the input/output control portion 50A-2 and the sound direct control portion 50A-3.

Figure 12:
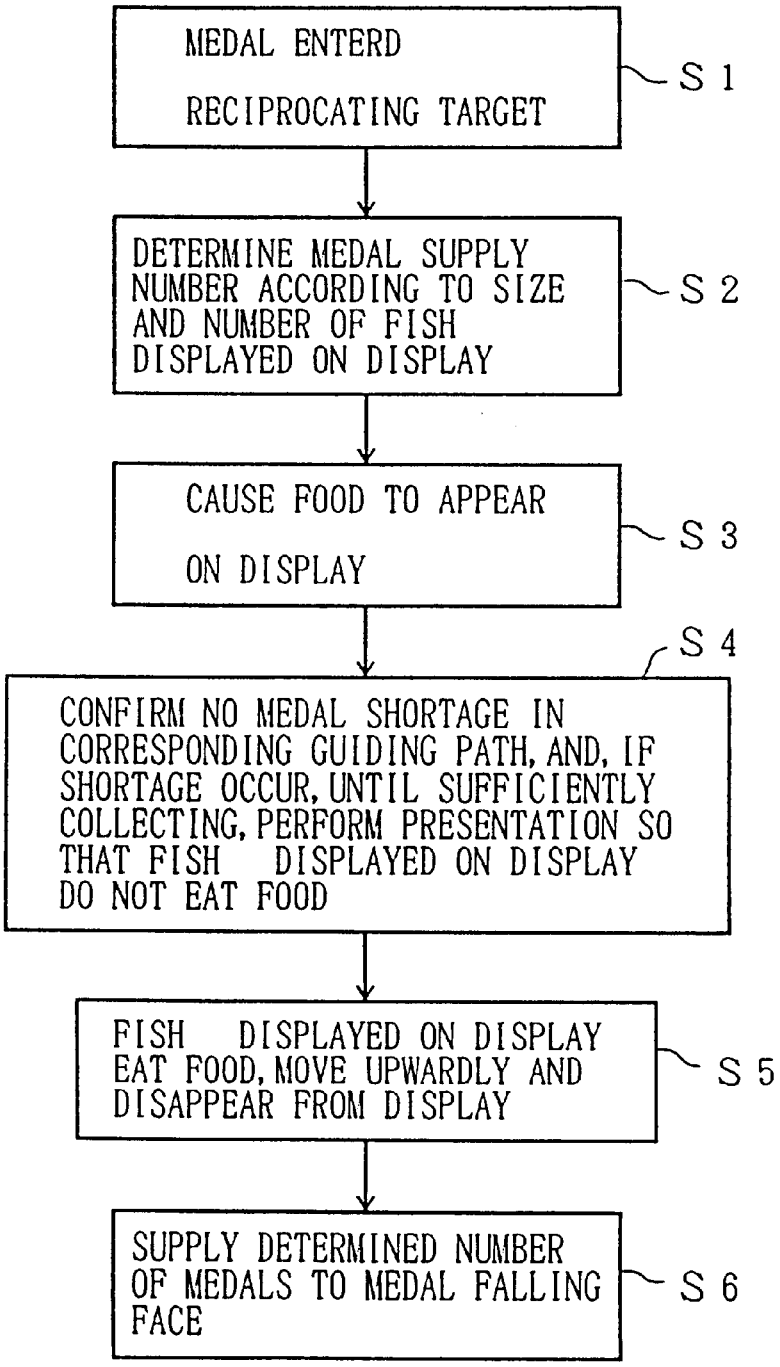
FIG. 12 is a flowchart showing an operation of the medal game apparatus of FIG. 1.
Figure 13A:
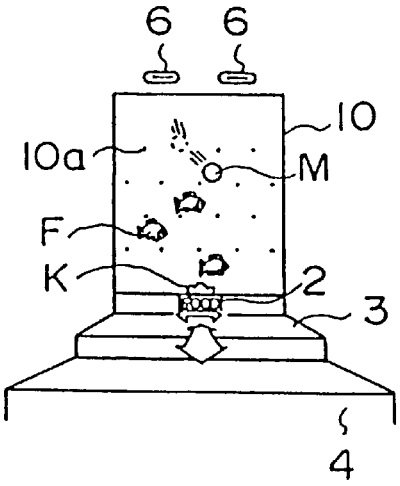
FIGS. 13(*a*)–13(*f*) are views showing synchronization of a picture on a display and an operation of the medal supply mechanism, in a case where a medal has entered the reciprocating target of the medal game apparatus of FIG. 1.
Figure 13D:
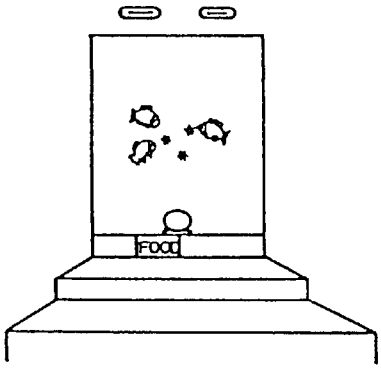
Figure 13B:
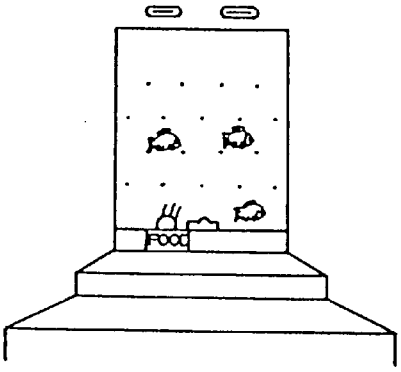
Figure 13E:
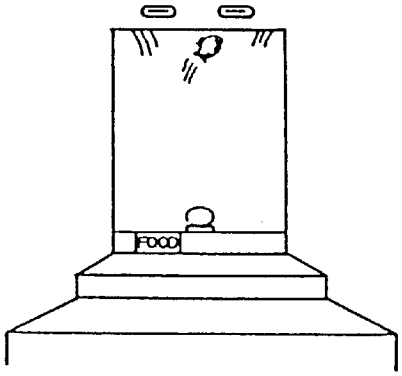
Figure 13C:
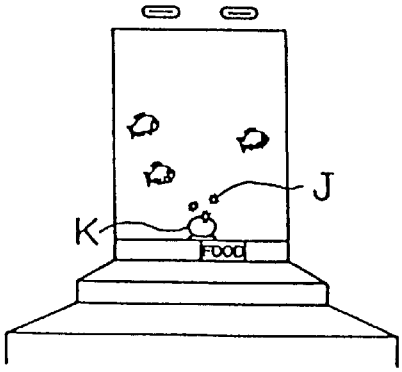
Figure 13F:
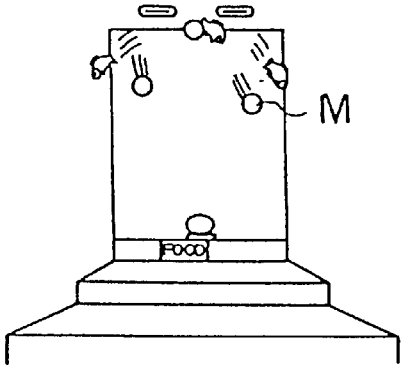

With reference to FIGS. 12 and 13, an operation of the game apparatus 1 when a medal M enters the reciprocating target 2, which is performed under control by the control circuit 50, will now be described.

A medal M, which has been deposited to the falling face 10 through the deposit hole 6 by an operator, as shown in FIG. 13 (*a*), hits pins 10*a* while falling along the falling face 10. Then, when the medal enters the reciprocating target 2 as shown in FIG. 13 (*b*) (S1 in FIG. 12), then, in S2 of FIG. 12, the medal supply number is determined according to the amount of fish which are displayed in a picture in front of the place when the medal enters the reciprocating target 2. The operation of S2 may be performed between the operation of S3 and the operation of S4 instead of being performed before the operation of S3 and the operation of S4.

Then, as shown in FIG. 13 (*c*), the lid of a shell K, displayed in a bottom portion of the display 7, opens, and food is released underwater (S3 of FIG. 12).

Then, in S4 of FIG. 12, it is confirmed whether there is a shortage of medals M which should collect in the guiding path, for the place, of the first and second guiding paths 33, 34 of FIG. 5. If a shortage occurred, until it is filled with medals through the operation of the hopper 31, fish movement is controlled appropriately so that the fish F displayed on the display 7 do not eat the food which was released underwater, as mentioned above. At this time, fish movement is controlled so that such a situation, where the fish do not eat the food although the food was released underwater, does not look unnatural, by expressing a situation where the fish cannot successfully find the food, for example.

Normally, as a result of the control circuit 50 controlling the pushing up hopper 31, the first and second guiding paths 33, 34 should be filled with medals. However, when, for example, a medal entered the reciprocating target 2 and a predetermined number of medals were supplied to the falling face 10 repeatedly, immediately before, in that place or the adjacent place which commonly uses the hopper 31, the situation may occur in which medal pushing by the hopper 31 is not quick enough so that a medal shortage occurs in each of the first and second guiding paths 33, 34.

When the corresponding first or second guiding path of the medal supply mechanism of the place is filled with medals or when the corresponding guiding path has been filled with medals as a result of, as mentioned above, fish movement on the display 7 being controlled while time is caused to elapse in the above-mentioned S4, the picture on the display is controlled so that the fish F start eating the food J, as shown in FIG. 13 (*d*). The picture is further controlled, and the fish having thus eaten the food start swimming toward the water surface (that is, the top end of the display 7), to disappear from the display 7 (S5 of FIG. 12). Then, the picture is controlled so that the fish may appear from the top end portion of the display 7 and get into the water just as if the fish fall into the water surface after jumping above the water surface for some time. Then, the medal supply mechanism 30 is also controlled, and thereby, simultaneously with the fish appearing at the top end of the display 7, the medal supply number of medals M, which was determined in the above-mentioned S2, are supplied to the falling face 10 of the place (S6 of FIG. 12 and FIG. 13 (*f*)).

In order to implement such control, through software programs in the main board portion 50A, fish F which are present in front of the place which are caused to rise toward the water surface according to a predetermined program, using data of a position, a coordinate moving speed, a moving direction of the fish F at a predetermined time, and so forth, thus simulating a movement in which the fish are jumping up above the water surface. As a result, the time at which the fish fall onto the water surface is calculated and controlled so that the corresponding medal supply gear 35 or 36 may be driven to correspond with a time at which medals M are supplied to the corresponding falling face 10. Further, other than a method using a time, another method can also be used in which the coordinate value of the fish F is monitored, and medals are supplied when that coordinate value becomes a specific value.

On the display 7, not only fish F but also, as the background thereof, seaweeds, rocks on the bottom of the water, and so forth are displayed for showing more reality. These hardly move in the screen, and, if they are displayed in such a state for a long time, the screen of the display may be damaged. In order to prevent such a situation, through a software program of the control circuit 50, the background is caused to move laterally periodically by such a slightly small degree that an operator does not notice.

In the game apparatus 1, one reciprocating target 2 is provided to each of the four place units. However, it is not limited to such an arrangement, and it is also possible that a common reciprocating target passes through the respective falling faces 10 of the four place units, one by one. In a case where such an arrangement is used, an arrangement may be set in which, when a medal falling along the falling face 10 has entered the common reciprocating target while the common reciprocating target is passing in front of the falling face 10 of a place unit, a predetermined number of medals may be supplied to the falling face 10 of that place.

Further, although the game apparatus 2 has the four place units, it is not limited to this arrangement. It is also possible that an apparatus has only one place unit, and it is also possible that it has a larger number of place units. Further, the game apparatus 1 is of a one face type and has a rectangle-shape. However, it is not limited to such. For example, a two face type is also possible, and it may also be that a plurality of place units are connected to form a circle.

Further, in the game apparatus 1, thin pins 10*a* are used as obstacles against a medal M on the falling face 10. However, it is not limited to such a shape, and, for example, thick cylindrical pins, such as those used in a pinball game, may be used. Further, in the game apparatus 1, metal pins are used as the pins 10*a* for strength. However, it is not limited to that, and, for example, in a case where thick cylindrical pins are used, the pins themselves may be of transparent acrylic resin, similar to the falling face 10.

Further, in the game apparatus 1, the photo-interrupter principle is specially used for detecting a medal M. However, it is not limited to this, and, for example, a mechanical detecting system of micro-switches or the like may be used.

Further, in the game apparatus 1, motors, solenoids and so forth are used as power sources of each mechanism. However, it is not limited to these, and other kinds of power sources can be used as long as they are power sources having similar functions.

An application of the present invention is not limited to the above-mentioned medal game apparatus, and it can also be applied to a pachinko game apparatus, a pinball game apparatus or the like. Objects which are displayed on the display are not limited to a picture in which fish swim. A picture which uses animals other than fish as the objects can also be used. Further, they are not limited to fish. For example, a picture of a car race or a horse race can also be used. For example, in a case where animals of a zoo appear, it can be considered that a falling face uses a wire netting instead of transparent acrylic resin. In this case, by making a mesh of the wire netting be smaller than the outer diameter of a medal M, to prevent a situation that a medal M drops into the opposite side, or the mesh is stuffed with a medal M.

It is also possible to provide a vibration detector for the water tank 13 and a software program of the main board portion 50A of FIG. 11 configured so that, when an operator hits the water tank, fish displayed on the display react.

Thus, the present invention is not limited to the above-mentioned embodiment, and other various embodiments can be implemented within a scope of the claims of the present application.

Industrial Applicability

Thus, according to the present invention, the lateral width of the falling space providing member is approximately the same as or smaller than the lateral width of the display. Thereby, the display accounts for a wide portion of the view of an operator, and, thereby, it is possible to increase an the operator's impression of the display (claim 1).

Further, the predetermined picture which is displayed on the display is automatically selected. Thereby, a troublesome operation is not needed, and various pictures are automatically selected and displayed. Thus, it is possible to increase the operator's interest in the game apparatus although management of the game apparatus is easy (claim 2).

Further, by providing the falling space providing member with a replaceable transparent resin cover, it is possible to keep the falling face flawless and stainless. Thereby, it is possible to always keep the display easy to be seen by an operator and it is possible to enhance the advantage resulting from the use of the large-size display to the maximum extent, and thereby, it is possible to increase an operator's interest (claim 3).

Further, by providing an obstacle which changes the falling track of a predetermined object, it is possible to produce various falling tracks for different predetermined objects, depending on how the obstacle is provided. Thereby, it is possible to produce falling tracks that an operator does not expect, and it is possible to increase the operator's interest (claim 4).

Further, by providing a transparent water tank in front of the display and filling it with water or oil, causing bubbles to be generated and so forth, it is possible to increase the illusion that the picture on display is actually underwater. Thereby, it is possible to exalt an operator's frame of mind, and it is possible to increase the operator's interest (claim 5).

Further, by providing a relationship between the predetermined object's falling movement and a picture on the display, an operator pays greater attention to the predetermined object's falling movement and also pays greater attention to the picture on the display. Thereby, it is possible to enhance an operator's concentration on a game. Accordingly, it is possible to exalt the operator's frame of mind, and thereby it is possible to increase the operator's interest (claim 6).

Further, a picture on the display is caused to have a relationship with the predetermined object's falling movement in each of a plurality of falling space providing portions. Thereby, each operator of a respective falling space providing member can know, to some degree, the predetermined object's movement in a falling space providing portion other than their own through the picture on the display. Therefore it is possible to know a game situation of another operator, to enable some sort of communication between a plurality of operators, and it is possible to increase each operator's interest in the game (claim 7).

Further, the target's movement is caused to have a relationship with the picture on the display, and, therefore, it appears from the operator's point of view as if the target is incorporated with the picture on the display. Therefore, it is possible to effectively use the target as a presentation effect, and thus increase an operator's interest (claim 8).

Further, an object supply operation by the object supplying means is caused to have a relationship with the picture on the display, and, therefore, an operator pays greater attention to the object supply operation and also to the display picture corresponding thereto. Thereby, it is possible to increase a presentation effect of the object supply operation, and thereby, it is possible to increase the operator's interest (claim 9).

Further, a predetermined number is determined depending on the displaying contents of the display at the time when an object enters the target, or the contents of the picture on display are caused to have a relationship with the predetermined number. Therefore, as a result of an operator paying attention to the picture on the display, and depositing a predetermined object to the falling space providing member at an appropriate time during a change in the picture, it is possible to cause a larger number of the predetermined objects to be supplied. Thereby, it is possible to enhance a relationship between the picture on the display and the progress of the game. Therefore, it is possible to bring out an effect of the display to the maximum, and thereby, it is possible to increase an operator's interest (claims 10, 11).

Further, by providing a plurality of falling space providing portions, it is possible for an operator, by seeing differences of display pictures between places, to select the falling space providing portion which is most advantageous at the time among the plurality of falling space providing portions, and to deposit the predetermined object to that falling space providing portion, so that the predetermined number of objects to be supplied is the maximum at the time. Therefore, it is possible that an operator does not use just a single falling space providing portion, but rather an operator may use a plurality of the falling space providing portions to cause the game to progress, and to greatly increase the operator's interest in the game (claim 12).

Further, the object supplying means causes the predetermined objects to be supplied to the falling space providing member with the orientation thereof being kept constant, and thereby, if, for example, the predetermined objects are medals, a surface thereof can be always kept in parallel with the surface of the falling space providing member. Therefore, it is possible to make the subject supplying means be thin, and also, to make the game apparatus itself be thin. Therefore, it is possible to reduce limitations of a game apparatus setting space (claim 13).

In addition, as a result of the object supplying means causing the predetermined objects to be supplied to the falling space providing member with the orientation thereof being kept constant, it is possible that the predetermined objects are, in a proper orientation, supplied to the falling space providing means. Thereby, it is possible to prevent the predetermined object from being stuffed in the middle of the falling space providing member, and thus, smooth game progress is possible (claim 13).

Further, deposited number counting means for counting the number of the predetermined objects which are deposited into the falling space by an operator; and ejected number counting means for counting the number of the predetermined objects which are ejected from the game apparatus as a result of many predetermined objects deposited to the falling space collecting at the bottom of the falling space are provided. Thereby, it is possible to monitor the game progress situation (claim 14).

Further, by controlling the number of the predetermined objects supplied to the falling space so that an operation value may be within a predetermined value range, the operation value being obtained from the deposited number which is counted by the deposited number counting means and the ejected number which is counted by the ejected number counting means, it is possible to provide a control so that the ratio between the deposited number and the ejected number may be within predetermined values. Thereby, it is possible to prevent a situation that the deposited number is too large in comparison with the ejected number or the ejected number is too large in comparison with the deposited number. Thereby, it is possible to effectively manage the contents of the game (claim 15).

Because it is possible to effectively manage the game contents, it is possible to appropriately increase an operator's interest, and also, to prevent a situation that the number of the predetermined objects supplied is too large (claim 14, 15).

Further, by providing a pushing up means (for pushing up the predetermined objects to an upper portion of the game apparatus), an object storing means (for storing in the upper portion of the game apparatus a predetermined number of the predetermined objects which have been thus pushed up), and a supplying means (for supplying the thus-stored predetermined objects to the falling space), it is possible to appropriately supply the predetermined objects when it is necessary through a relatively compact arrangement, and to supply the predetermined objects in a timely manner. Therefore, it is possible to make the game apparatus have a compact arrangement, and also, to increase an operator's interest (claim 16).

Further, by disposing the supplying means right above the falling space, it is possible to precisely control timing of supplying the predetermined objects to the falling space (claim 17).

Further, by supplying the predetermined objects intermittently to the falling space, it is possible to easily count the predetermined objects (claim 17).

Further, by providing stopping means for braking a motor driving the supply means, it is possible to prevent the situation in which that the motor is rotated too much due to the inertia of the motor and the supplying means, which thereby causes too many predetermined objects to be supplied. Accordingly, a smooth and proper operation of the game apparatus is possible (claim 18).

Further, it comprises a rising guiding means for guiding so that the predetermined objects pushed up by the pushing up means may reach the predetermined position of the upper portion of the game apparatus. Additionally, the object storing means comprises supply guiding means for guiding so that the predetermined objects thus pushed up to the predetermined position of the upper portion of the game apparatus, may be then supplied to the falling space. Thereby, the predetermined objects are positively guided in a predetermined orientation, to be pushed up to the upper portion of the game apparatus and be supplied to the falling space. Thus, game progress is smoothly performed (claim 19).

Further, it comprises an object rising sensor for detecting the predetermined object pushed up by the pushing up means and a control means for causing the pushing up means to operate when the predetermined object is not detected by the object rising sensor. Thereby, it is possible to always maintain a state that a predetermined number of the predetermined objects have been pushed up. Thereby, it is possible to supply the predetermined objects appropriately when it is necessary. When supply of the predetermined objects is necessary, it is possible to supply them immediately (claim 20).

Further, also in a case where a plurality of falling space providing portions are provided, a common pushing up means and a plurality of the object storing means and supplying means are provided, as well as a distributing means for performing distribution thereto. Therefore, it is possible to supply the predetermined objects to the respective falling spaces through a relatively compact arrangement. Therefore, it is possible to effectively supply the predetermined objects through the relatively compact arrangement even for the game apparatus having a plurality, of place units (claim 21).

Further, it comprises an object rising sensor for detecting the predetermined object pushed up by the pushing up means, object storing sensors for detecting the predetermined objects stored by the plurality of object storing means, respectively, and control means for causing the pushing up means to operate when the predetermined object is not detected by the object rising sensor, and controlling the distributing means so that the predetermined objects may be supplied to the object storing means for which the predetermined object is not detected by the object storing sensor. Thereby, it is possible to properly supply the predetermined objects to the plurality of place units. Thereby, it is possible to appropriately supply a predetermined number of predetermined members, when it is necessary, to the respective falling spaces. It is possible to effectively supply the predetermined objects through a relatively compact arrangement even for the game apparatus having the plurality of place units (claim 22).

Thus, according to the present invention, it is possible to provide a game apparatus in which, through a compact arrangement, it is possible to positively perform a smooth game operation, and also to effectively increase an operator's interest.

We claim:

1. A game apparatus comprising:

a display for displaying a predetermined picture, wherein said predetermined picture is dynamic; and a falling space providing member, provided in front of said display, for providing a falling space for a predetermined object, wherein, said falling space providing member is such that, therethrough from a front side, said predetermined picture displayed on said display can be seen; and the lateral width of said falling space providing member is approximately the same as or smaller than a lateral width of said display.

2. The game apparatus according to claim 1, further comprising a selecting means for automatically selecting said predetermined picture which is displayed on said display.

3. The game apparatus according to claim 1, wherein said falling space providing member is a transparent resin, and is provided with a replaceable transparent resin cover.

4. The game apparatus according to claim 1, wherein said falling space is provided with at least one obstacle which causes a falling track of said predetermined object to change.

5. The game apparatus according to claim 1, further comprising an approximately transparent thin water tank which is provided in front of said display, wherein said thin water tank is provided separately from said falling space.

6. The game apparatus according to claim 1, further comprising: a control means for providing a relationship between the falling movement of said predetermined object and the movement of said predetermined picture displayed on said display, wherein said movement of said predetermined picture has a predetermined relationship with said movement of said falling object.

7. The game apparatus according to claim 6, wherein:

said falling space providing member has a plurality of falling space providing portions, each of which can provide a falling space for said predetermined object; and further wherein said control means causes movement of said predetermined picture displayed on said display to have a relationship with said predetermined object's falling movement in each of said plurality of falling space providing portions.

8. The game apparatus according to claim 1, further comprising a target, to which said predetermined object can provide a predetermined action and which performs a movement having a relationship with a movement of said predetermined picture displayed on said display.

9. The game apparatus according to claim 1, further comprising:

a target, to which said predetermined object can provide a predetermined action;

object supplying means for supplying a predetermined number of said predetermined objects to said falling space when said predetermined object has provided said predetermined action to said target; and control means for providing a relationship between the object supplying operation of said object supplying means and a movement of said predetermined picture displayed on said display.

10. The game apparatus according to claim 1, further comprising:

a target, to which said predetermined object can provide a predetermined action; and an object supplying means for supplying a predetermined number of said predetermined objects to said falling space when said predetermined object has provided said predetermined action to said target, wherein said predetermined number is determined based on the displaying contents of said display at the time when said predetermined object enters said target.

11. The game apparatus according to claim 1, further comprising:

a target, to which said predetermined object can provide a predetermined action; and an object supplying means for supplying a predetermined number of said predetermined objects to said falling space when said predetermined object has provided said predetermined action to said target; and control means for causing the contents of said predetermined picture displayed on said display to have a relationship with said predetermined number.

12. The game apparatus according to claim 1, wherein said falling space providing member comprises a plurality of falling space providing portions, each of which provides a falling space for said predetermined object, and each of which further comprises:

at least one target, which is provided within each of said plurality of falling space providing portions and to which said predetermined object can provide a predetermined action; and an object supplying means for supplying a predetermined number of said predetermined objects to the corresponding falling space when said predetermined action has been provided by said predetermined object to any one of a plurality of said targets, wherein said predetermined number is determined by the displaying contents of the corresponding portion of said display at the time when said predetermined object has entered said target.

13. The game apparatus according to claim 1, wherein said game apparatus is a medal game.

14. The game apparatus according to claim 1, wherein said game apparatus is a ball game.

15. A game apparatus comprising:

a falling space providing member for providing a falling space of a predetermined object;

a target, to which said predetermined object can provide a predetermined action; and an object supplying means for supplying a predetermined number of said predetermined objects to said falling space when said predetermined object has provided said predetermined action to said target, and for keeping the orientation of said predetermined objects constant to said falling space;

an object storing means for storing said objects in parallel with said falling space, wherein said object supplying means supplies said objects to said falling space in the same orientation in which said objects have been stored in said object storing means.

16. The game apparatus according to claim 15, wherein said game apparatus is a medal game.

17. The game apparatus according to claim 15, wherein said game apparatus is a ball game.

18. A game apparatus comprising:

a falling space providing member for providing a falling space for a predetermined object;

a deposited number counting means for counting the number of said predetermined objects which are deposited into said falling space by an operator; and an ejected number counting means for counting the number of said predetermined objects which are ejected from said game apparatus as a result of many predetermined deposited objects collecting at a bottom of said falling space;

an object supplying means for supplying a predetermined number of said predetermined objects to said falling space when said predetermined object has provided said predetermined action to said target, and for keeping the orientation of said predetermined objects constant to said falling space; and a control means for controlling said object supplying means and the supply of said predetermined objects to said falling space so that an operation value may be within a predetermined value range, said operation value being obtained from the deposited number which is counted by said deposited number counting means and the ejected number which is counted by said ejected number counting means.

19. The game apparatus according to claim 18, wherein said object supplying means comprises: a pushing up means for pushing up the predetermined objects to an upper portion of said game apparatus;

an object storing means for storing in said upper portion of said game apparatus a predetermined number of said predetermined objects, which have been pushed up, while keeping the orientation thereof constant.

20. The game apparatus according to claim 19, wherein said supplying means intermittently supplies said predetermined number of said predetermined objects above said falling space.

21. The game apparatus according to claim 20, wherein said supplying means is driven by a motor provided with stopping means for braking said motor so as to cause said motor to stop each time a predetermined number of said predetermined objects are supplied.

22. The game apparatus according to claim 19, further comprising: rising guiding means for guiding so that said predetermined objects pushed up by said pushing up means are aligned in a predetermined orientation and reach said upper portion of said game apparatus, and wherein said object storing means comprises a supply guiding means for guiding so that said predetermined objects, thus pushed up to a predetermined position of said upper portion of said game apparatus, may be supplied, with the orientation thereof being kept constant, to said falling space.

23. The game apparatus according to claim 19, further comprising:

an object rising sensor for detecting said predetermined object pushed up by said pushing up means; and a control means for causing said pushing up means to operate when said predetermined object is not detected by said object rising sensor.

24. The game apparatus according to claim 19, wherein:

said falling space providing member comprises a plurality of falling space providing portions, each of which provides a falling space for said the predetermined objects;

said target being provided to each of a plurality of said falling spaces; wherein, said object supplying means supplies to the corresponding falling space a predetermined number of said predetermined objects when a predetermined action has been provided to any one of a plurality of said targets by said predetermined object, the number of said object storing means and said supply guiding means provided being the same as the number of the falling spaces so that said predetermined objects may be supplied to the respective falling spaces; and a distributing means for distributing said predetermined objects pushed up by said pushing up means into a plurality of said object storing means.

25. The game apparatus according to claim 24, further comprising:

an object rising sensor for detecting said predetermined object pushed up by said pushing up means;

object storing sensors for detecting the predetermined objects stored by said plurality of object storing means, respectively; and a control means for causing said pushing up means to operate when said predetermined object is not detected by said object rising sensor, and for controlling said distributing means so that said predetermined objects may be supplied to said object storing means when said predetermined object is not detected by said object storing sensor.

26. The game apparatus according to claim 18 wherein said game apparatus is a medal game.

27. The game apparatus according to claim 18, wherein said game apparatus is a ball game.

* * * * *

UNITED STATES PATENT AND TRADEMARK OFFICE
CERTIFICATE OF CORRECTION

PATENT NO. : 5,951,009

DATED : September 14, 1999

INVENTOR(S) : Kojiro Miyamoto et al.

It is certified that an error appears in the above-identified patent and that said Letters Patent is hereby corrected as shown below:

Column 22 – claim 18, line 15:

"said predetermined action" should read

--a predetermined action--.

Signed and Sealed this

Thirtieth Day of May, 2000

*Attest:*

Q. TODD DICKINSON

*Attesting Officer*

*Director of Patents and Trademarks*